US010478827B2

(12) United States Patent
Soleymani et al.

(10) Patent No.: US 10,478,827 B2
(45) Date of Patent: Nov. 19, 2019

(54) DEVICES FOR MANIPULATING MAGNETIC PARTICLES, AND METHODS OF FABRICATING THE DEVICES AND THE USE THEREOF

(71) Applicant: McMaster University, Hamilton (CA)

(72) Inventors: Leyla Soleymani, Oakville (CA); Seyed Mohammadamin Hosseini, Hamilton (CA)

(73) Assignee: MCMASTER UNIVERSITY, Hamilton (CA)

( * ) Notice: Subject to any disclaimer, the term of this patent is extended or adjusted under 35 U.S.C. 154(b) by 504 days.

(21) Appl. No.: 15/060,835

(22) Filed: Mar. 4, 2016

(65) Prior Publication Data

US 2016/0260534 A1 Sep. 8, 2016

Related U.S. Application Data

(60) Provisional application No. 62/127,856, filed on Mar. 4, 2015.

(51) Int. Cl.
*B03C 1/28* (2006.01)
*B03C 1/033* (2006.01)
(Continued)

(52) U.S. Cl.
CPC ..... *B03C 1/288* (2013.01); *B03C 1/0335* (2013.01); *B03C 1/286* (2013.01); *H01F 41/308* (2013.01);
(Continued)

(58) Field of Classification Search
CPC ..... B03C 1/288; B03C 1/0335; B03C 1/286; B03C 2201/26; B03C 2201/18; H01F 41/308; H01F 2007/068
See application file for complete search history.

(56) References Cited

U.S. PATENT DOCUMENTS 6,466,404 B1 * 10/2002 Crue, Jr. ..... B82Y 10/00 360/123.25
6,806,050 B2 10/2004 Zhou et al.

OTHER PUBLICATIONS

Fu et al., "Tunable Nanowrinkles on Shape Memory Polymer Sheets", Adv. Mater. 21, 4472, 2009.
(Continued)

*Primary Examiner* — David C Mellon
(74) *Attorney, Agent, or Firm* — Bereskin & Parr LLP/S.E.N.C.R.L., S.R.L.

(57) ABSTRACT

A device for manipulating magnetic particles, and the method of fabricating and use thereof. The device includes a substrate; a conductive element formed onto the substrate in a pattern shaped to enhance a magnetic field generated in response to an applied current; an insulating layer to isolate the conductive element from a magnetic element; and a magnetic element formed onto the insulating layer to enhance a magnetic force resulting from the magnetic field generated by the conductive element. The magnetic element can be shaped similarly to the conductive element, and edges of the magnetic element are substantially aligned with edges of the conductive element. During fabrication, the substrate and the conductive element can be heated to cause the substrate to shrink thereby resulting in a wrinkled structure at the conductive element. The device can be used to manipulate the magnetic particles within a biological sample, such as cells and/or biomolecules.

30 Claims, 22 Drawing Sheets

(51) Int. Cl.
*H01F 41/30* (2006.01)
*H01F 7/06* (2006.01)

(52) U.S. Cl.
CPC ..... *B03C 2201/18* (2013.01); *B03C 2201/26* (2013.01); *H01F 2007/068* (2013.01)

(56) References Cited

OTHER PUBLICATIONS

Abdel-Karim et al., "Electrodeposition and Characterization of Nanocrystalline Ni—Fe Alloys", Journal of Nanomaterials, vol. 2011, pp. 1-8, 2011.
Abidin et al., "Design and Simulation of High Magnetic Gradient Device for Effective Bioparticles Trapping", 10th IEEE Int. Conf. Semicond. Electron., pp. 195-199, 2012.
Ahn et al., "Micromachined Planar Inductor on Silicon Wafers for MEMS Applications", IEEE Transactions on Industrial Electronics, vol. 45, No. 6, 1998.
Bu et al., "Characterization of a microfluidic magnetic bead separator for high-throughput applications", Sensors and Actuators A Phys. 145-146, pp. 430-436, 2008.
Choi et al., "A new magnetic bead-based, filterless bio-separator with planar electromagnet surfaces for integrated bio-detection systems", Sensors and Actuators B 68, pp. 34-39, 2000.
Choi et al., "An on-chip magnetic bead separator using spiral electromagnets with semi-encapsulated permalloy", Biosensors & Bioelectronics 16, pp. 409-416, 2001.
Coudron et al., "Low-cost credit card-based microfluidic devices for magnetic bead immobilisation", Microfluid Nanofluid,14, pp. 359-369, 2013.
Do et al., "Low-Cost Magnetic Interdigitated Array on a Plastic Wafer", IEEE Transactions on Magnetics, vol. 40, No. 4, pp. 3009-3011, 2004.
Drndic et al., "Micro-electromagnets for atom manipulation", Applied Physics Letters, vol. 72, No. 22, pp. 2906-2908, 1998.
Dubus et al., "PCR-Free DNA Detection Using a Magnetic Bead-Supported Polymeric Transducer and Microelectromagnetic Traps", Anal. Chem., 78, pp. 4457-4464, 2006.
Fulcrand et al., "On chip magnetic actuator for batch-mode dynamic manipulation of magnetic particles in compact lab-on-chip", Sensors and Actuators B 160, pp. 1520-1528, 2011.
Gabardo et al., "Bench-Top Fabrication of Hierarchically Structured High-Surface-Area Electrodes", Adv. Funct. Mter., 23, pp. 3030-3039, 2013.
Gan et al., "A Novel Signal-Amplified Immunoassay for the Detection of C-Reactive Protein Using HRP-Doped Magnetic Nanoparticles as Labels with the Electrochemical Quartz Crystal Microbalance as a Detector", Journal of Analytical Methods in Chemistry, vol. 2013, pp. 1-8, 2013.
Gangasingh et al., "Anomalous electrodeposition of Nickel-Iron", J. Electrochem. Soc., vol. 138, No. 12, 1991.
Gijs, "Magnetic bead handling on-chip: new opportunities for analytical applications", Microfluid Nanofluid, 1, pp. 22-40, 2004.
Gijs et al., "Microfluidic Applications of Magnetic Particles for Biological Analysis and Catalysis", Chem. Rev., 110, pp. 1518-1563, 2010.
Gu et al., "Using Biofunctional Magnetic Nanoparticles to Capture Vancomycin-Resistant Enterococci and Other Gram-Positive Bacteria at Ultralow Concentration", J. Am. Chem. Soc. 125, pp. 15702-15703, 2003.
Hosseini et al., "Benchtop fabrication of multi-sale micro-electromagnets for capturing magnetic particles", Applied Physics Letters, 105, 074102, 2014.
Inglis et al., "Continuous microfluidic immunomagnetic cell separation", Applied Physics Letters, vol. 85, 21, pp. 5093-5595, 2004.
Katz et al., "Integrated Nanoparticle-Biomolecule Hybrid Systems: Synthesis, Properties, and Applications", Angew. Chem. Int. Ed. 43, pp. 6042-6108, 2004.
Lee et al., "Controlled Assembly of Magnetic Nanoparticles from Magnetotactic Bacteria Using Microelectromagnets Arrays", Nano Letters, vol. 4, No. 5, pp. 995-998, 2004.
Lee et al., "Microelectromagnets for the control of magnetic nanoparticles", Applied Physics Letters, 79, pp. 3308-3310, 2001.
Lehmann et al., "Droplet-Based DNA Purification in a Magnetic Lab-on-a-Chip", Angew. Chem. Int. Ed., 45, pp. 3062-3067, 2006.
Lu et al., "Magnetic Nanoparticles: Synthesis, Protection, Functionalization, and Application", Angew. Chem. Int. Ed., 46, pp. 1222-1244, 2007.
Miltenyi et al., "High Gradient Magnetic Cell Separation with MACS", Cytometry, 11, pp. 231-238, 1990.
Nam et al., "Bio-Bar-Code-Based DNA Detection with PCR-Like Sensitivity", J. Am. Chem. Soc., 126, pp. 5932-5933, 2004.
Nam et al., "Nanoparticle-Based Bio-Bar Codes for the Ultrasensitive Detection of Proteins", Science, vol. 301, pp. 1884-1886, 2003.
Nawarathna et al., "Shrink-induced sorting suing integrated nonscale magnetic traps", Applied Physics Letters, 102, 2013.
Pamme, "Magnetism and microfluidics", Lab Chip, 6, pp. 24-38, 2006.
Parkhust et al., "Applications of magnetic nanoparticles in biomedicine", J. Phys. D: Appl. Phys., 36. pp. 167-181, 2003.
Park et al., "Electrodepositionof Permalloy in Deep Silicon Trenches without Edge-Overgrowth Utilizing Dry Film Photoresist", Micro Electro Mech. Syst., MEMS 2009, IEEE 22nd Int. Conf., pp. 689-692, 2009.
Perez et al., "Viral-Induced Self-Assembly of Magnetic Nanoparticles Allows the Detection of Viral Particles in Biological Media", J. Am. Chem. Soc. 125, pp. 10192-10193, 2003.
Ramadan et al., "On-chip micro-electromagnets for magnetic-based bio-molecules separation", Journal of Magnetism and Magnetic Materials, 281, pp. 150-172, 2004.
Ramadan et al., "Magnetic-based microfluidic platform for biomolecular separation", Biomed Microdevices, 8, pp. 151-158, 2006.
Ramadan et al., "Customized trapping of magnetic particles", Microfluid Nanofluid, 6, pp. 53-62, 2009.
Smistrup et al., "Magnetic separation in microfluidic systems using microfabricated electromagnets—experiments and simulations", Journal of Magnetism and Magnetic Materials, 293, pp. 597-604, 2005.
Yanai et al., "Electrodeposited Fe—Ni Films Prepared in a Citric-Acid-Based Bath with Different pH Values", IEEE Transactions on Magnets, vol. 50, 1, 2014.

* cited by examiner

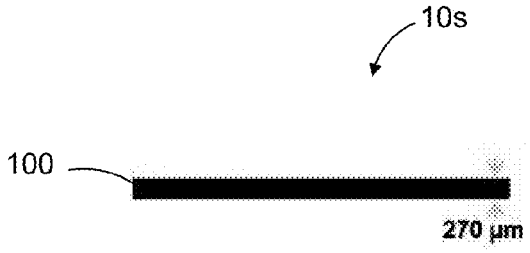
FIG. 1.1a
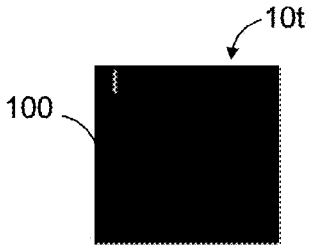
FIG. 1.1b
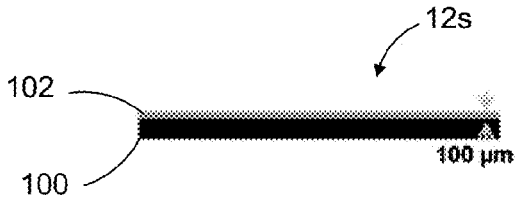
FIG. 1.2a
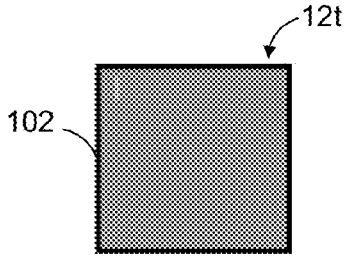
FIG. 1.2b
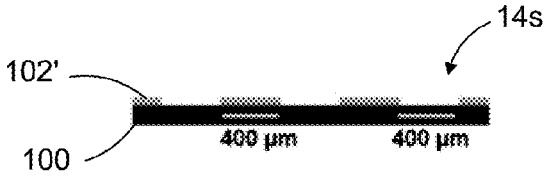
FIG. 1.3a
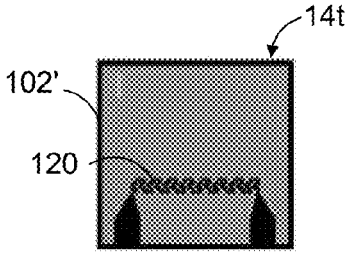
FIG. 1.3b
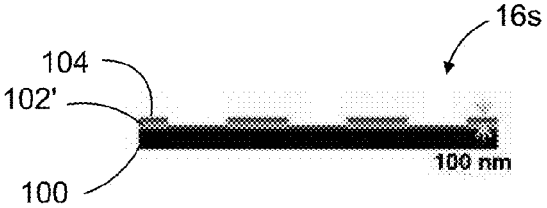
FIG. 1.4a
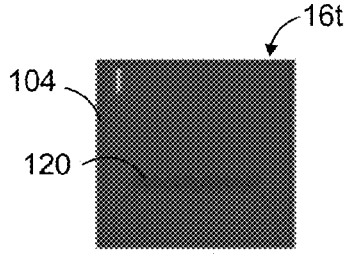
FIG. 1.4b
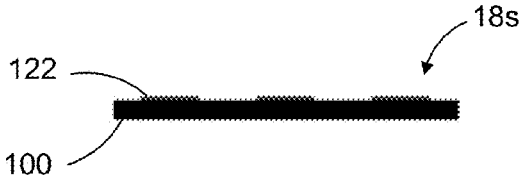
FIG. 1.5a
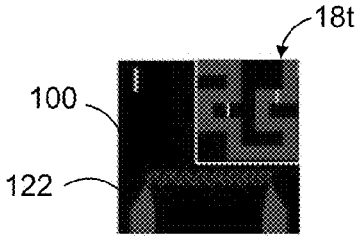
FIG. 1.5b

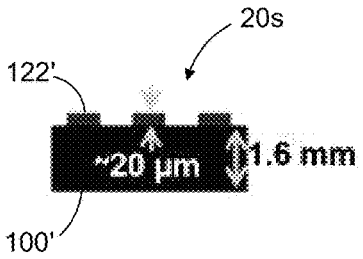
FIG. 1.6a
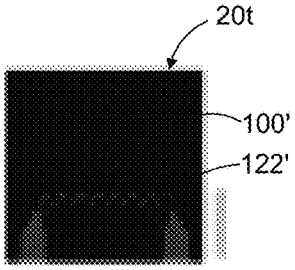
FIG. 1.6b
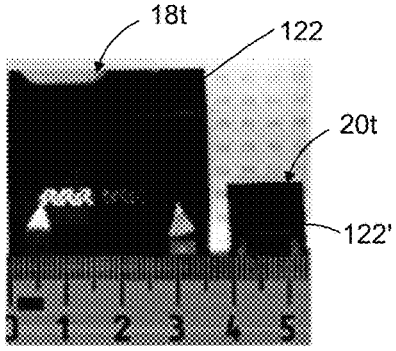
FIG. 1.6c
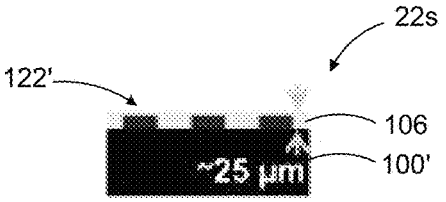
FIG. 1.7a
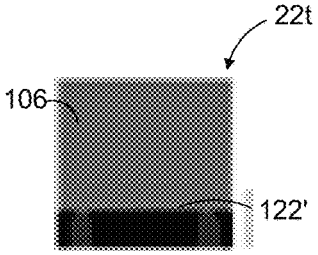
FIG. 1.7b
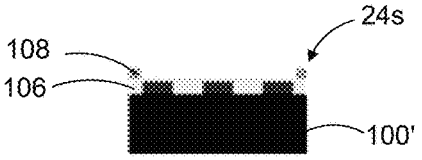
FIG. 1.8a
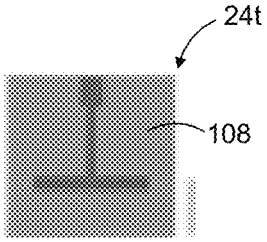
FIG. 1.8b
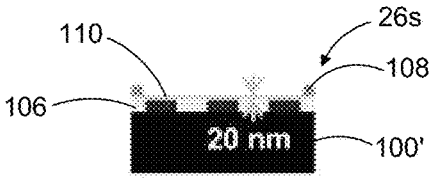
FIG. 1.9a
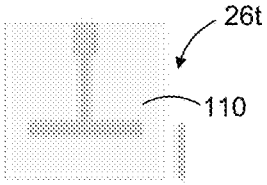
FIG. 1.9b

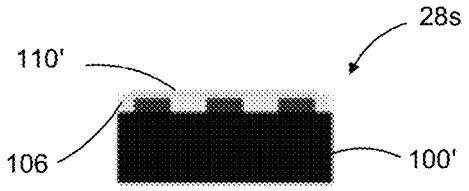
FIG. 1.10a
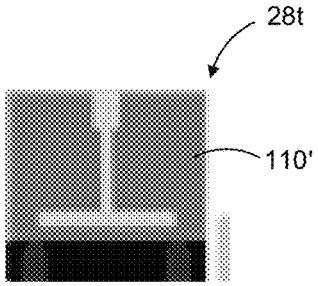
FIG. 1.10b
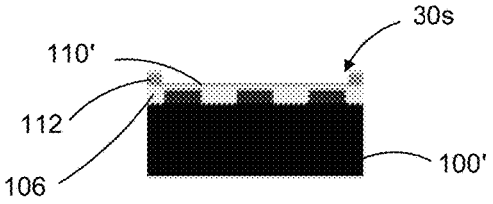
FIG. 1.11a
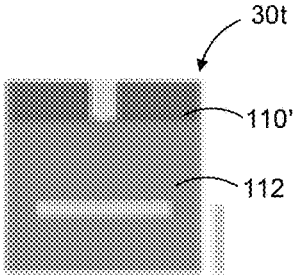
FIG. 1.11b
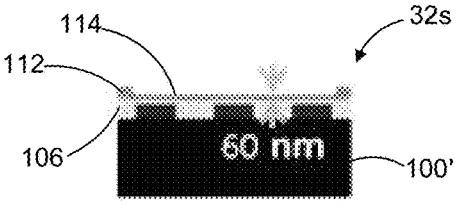
FIG. 1.12a
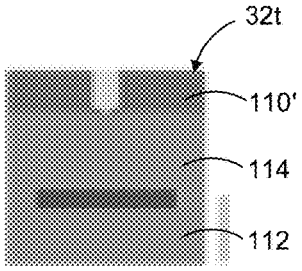
FIG. 1.12b
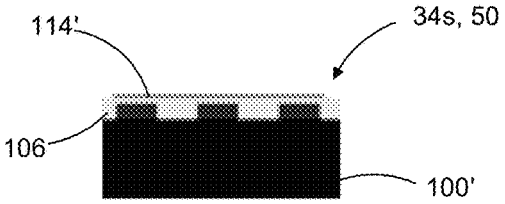
FIG. 1.13a
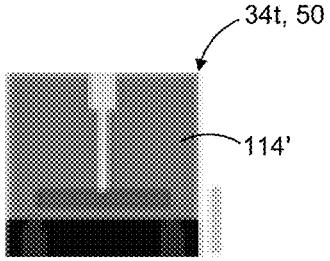
FIG. 1.13b

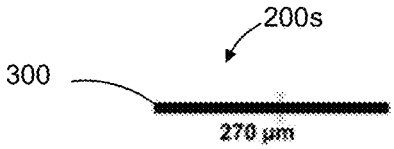
FIG. 2.1a
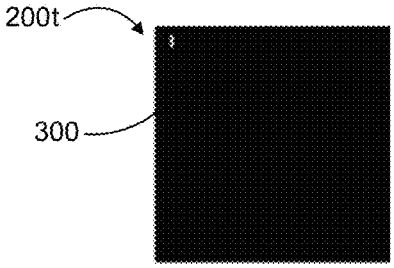
FIG. 2.1b
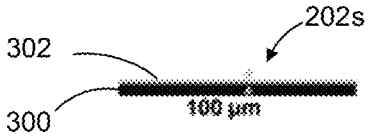
FIG. 2.2a
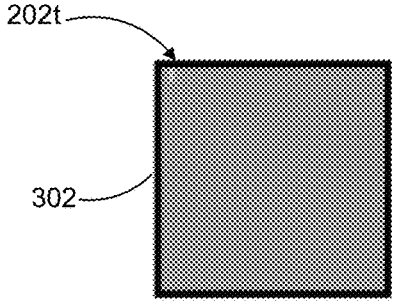
FIG. 2.2b
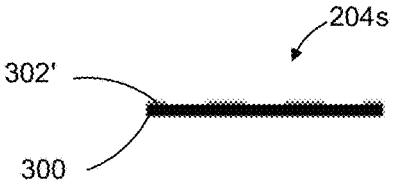
FIG. 2.3a
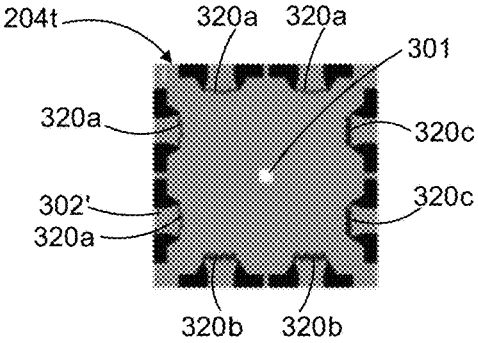
FIG. 2.3b
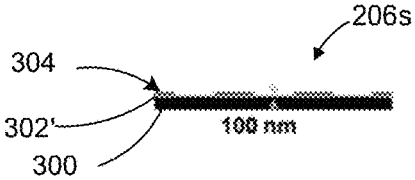
FIG. 2.4a
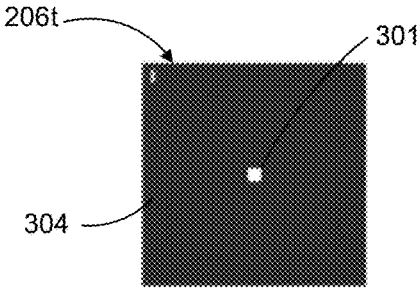
FIG. 2.4b

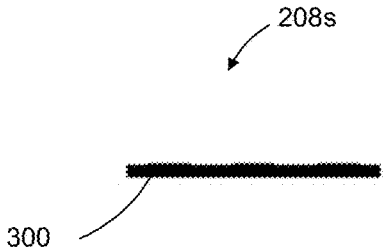
FIG. 2.5a
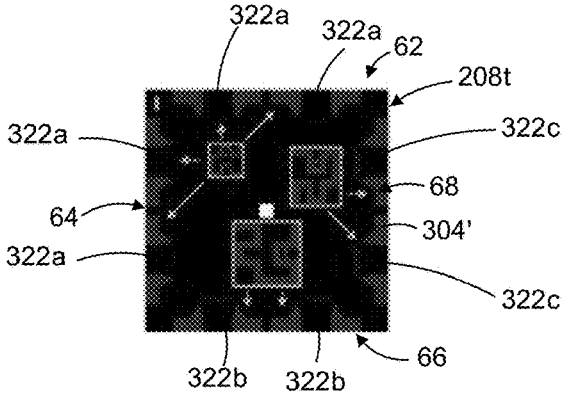
FIG. 2.5b
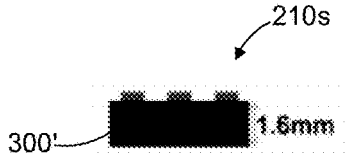
FIG. 2.6a
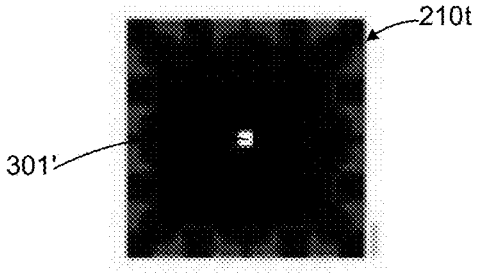
FIG. 2.6b
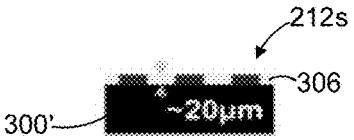
FIG. 2.7a
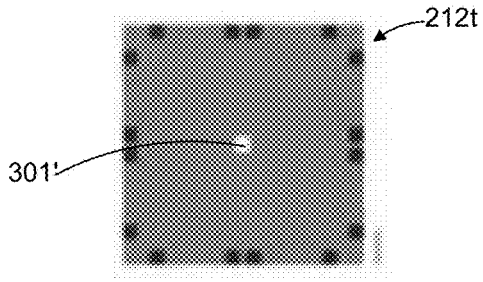
FIG. 2.7b
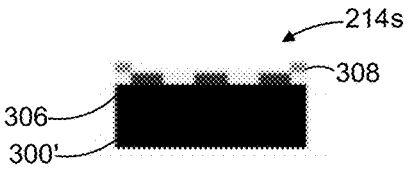
FIG. 2.8a
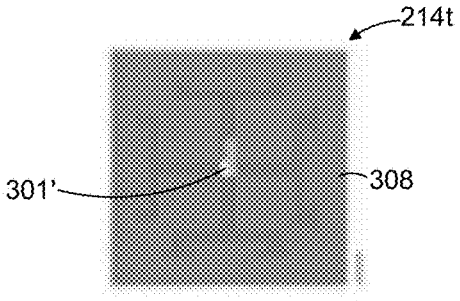
FIG. 2.8b

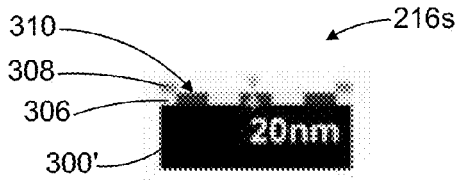
FIG. 2.9a
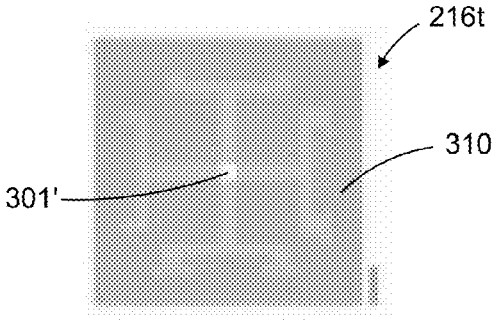
FIG. 2.9b
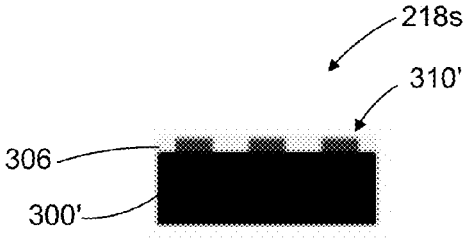
FIG. 2.10a
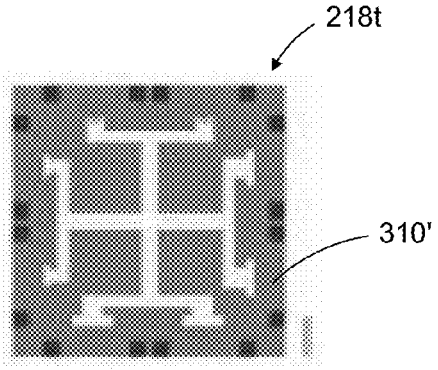
FIG. 2.10b
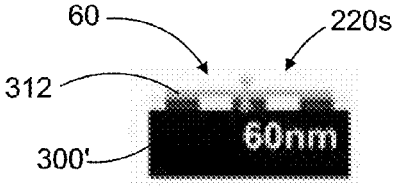
FIG. 2.11a
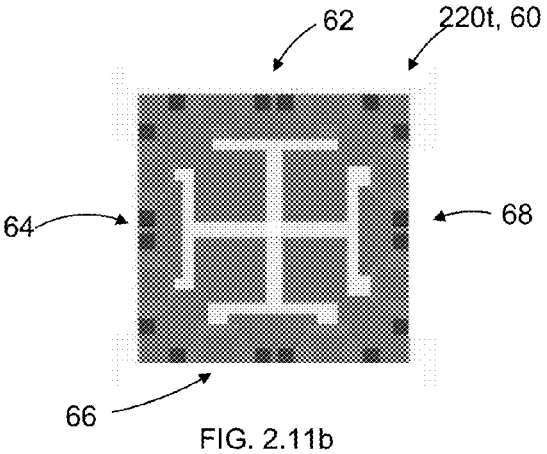
FIG. 2.11b

DEVICES FOR MANIPULATING MAGNETIC PARTICLES, AND METHODS OF FABRICATING THE DEVICES AND THE USE THEREOF

CROSS-REFERENCE TO RELATED PATENT APPLICATIONS

This application claims the benefit of U.S. Provisional Application No. 62/127,856 entitled "Benchtop Fabrication of Multi-Scale Micro-Electromagnets for Capturing Magnetic Particles", which was filed on Mar. 4, 2015. The entirety of U.S. Provisional Application No. 62/127,856 is hereby incorporated by reference.

FIELD

The described embodiments relate to devices for manipulating magnetic particles and the methods of fabricating the devices and the use thereof.

BACKGROUND

Chip-based biosensors are increasingly used for detecting diseases at point-of-cares. Due at least to the portability of chip-based biosensors, chip-based biosensors can facilitate early detection of diseases and can act as diagnostics solutions in resource-limited environments.

In order to detect diseases, specific cells or biomolecules such as proteins and/or nucleic acids, will typically need to be isolated from a biological sample. Functionalized magnetic particles can be used to filter out those specific biomolecules and to suspend those functionalized magnetic particles into a known solution. The known solution can have a specific composition and volume. The functionalized magnetic particles can then be extracted from the known solution with magnetic elements, such as external magnets, on-chip magnets, and/or micro-electromagnets.

Although separating the functionalized magnetic particles with external magnets offers simplicity, on-chip magnets can offer other benefits.

SUMMARY

The various embodiments described herein generally relate to devices for manipulating magnetic particles and the methods of fabricating the devices and the use thereof.

In accordance with an embodiment, there is provided a device for manipulating magnetic particles. The device includes: a substrate; a conductive element formed onto the substrate in a pattern shaped to enhance a magnetic field generated in response to a current applied to the conductive element; an insulating layer to isolate the conductive element from a magnetic element; and a magnetic element formed onto the insulating layer to enhance a magnetic force resulting from the magnetic field generated by the conductive element.

In some embodiments, the device includes a metallic seed layer deposited onto the insulating layer to act as a conductive path for a growth of the magnetic element. The metallic seed layer may include one of copper, titanium, titanium oxide, titanium nitride, tungsten, aluminum, chromium, and noble metals.

In some embodiments, the conductive element includes a wrinkled structure resulting from the substrate being shrunk during fabrication of the device.

In some embodiments, the conductive element includes a microstructure with a high aspect ratio and/or a nanostructure with a high aspect ratio.

In some embodiments, the conductive element includes an on-chip coil.

In some embodiments, the magnetic element is shaped in the pattern of the conductive element, and edges of the magnetic element are substantially aligned with corresponding edges of the conductive element.

In some embodiments, the pattern includes a meandering design. The meandering design can have a mesh shape.

In some embodiments, the substrate includes a shrinkable material.

In some embodiments, the substrate includes a polymer material. The polymer material can be composed of at least one of a pre-stressed polystyrene, polyolefin and polyethylene films.

In some embodiments, the conductive element includes one of copper, titanium, titanium oxide, titanium nitride, tungsten, aluminum, chromium, and noble metals.

In some embodiments, the magnetic element includes one of nickel, iron, permalloy, supermalloy, mu-metal, cobalt-iron alloy, and nickel-iron alloy.

In accordance with an embodiment, there is provided a use of the device described herein for manipulating the magnetic particles within a biological sample, such as cells and/or biomolecules.

In accordance with an embodiment, there is provided a method for fabricating a device for manipulating magnetic particles. The method includes: providing a substrate; forming a conductive element onto the substrate in a pattern shaped to enhance a magnetic field generated in response to a current applied to the conductive element; heating the substrate and the conductive element to cause the substrate to shrink thereby resulting in a wrinkled structure at the conductive element; depositing an insulating layer onto the conductive element to isolate the conductive element from a magnetic element; and forming a magnetic element onto the insulating layer, the magnetic element enhancing a magnetic force resulting from the magnetic field generated by the conductive element.

In some embodiments, the method includes depositing a metallic seed layer onto the insulating layer to act as a conductive path for a growth of the magnetic element.

In some embodiments, forming the conductive element includes: providing a mask onto the substrate; removing a portion of the mask to define the pattern for forming the conductive element; depositing a conductive material onto a remainder of the mask; and removing the remainder of the mask to obtain the conductive element.

In some embodiments, removing the portion of the mask includes cutting out the portion of the mask.

In some embodiments, the methods described herein include depositing a conductive material onto the remainder of the mask via one of physical vapour deposition, chemical vapour deposition, electrodeposition, electroless deposition, and self-assembly.

In some embodiments, forming the magnetic element includes: forming the magnetic element into the pattern; and substantially aligning edges of the patterned magnetic element with corresponding edges of the pattern conductive element.

BRIEF DESCRIPTION OF THE DRAWINGS

Several embodiments will now be described in detail with reference to the drawings, in which:

FIG. 1.1*a* is a side view of a partially constructed device at an initial stage of an example fabrication process, in accordance with an example embodiment;

FIG. 1.1*b* is a top view of the partially constructed device shown in FIG. 1.1*a;*

FIG. 1.2*a* is a side view the partially constructed device of FIG. 1.1*a* at a later stage of the example fabrication process;

FIG. 1.2*b* is a top view of the partially constructed device shown in FIG. 1.2*a;*

FIG. 1.3*a* is a side view the partially constructed device of FIG. 1.2*a* at a later stage of the example fabrication process;

FIG. 1.3*b* is a top view of the partially constructed device shown in FIG. 1.3*a;*

FIG. 1.4*a* is a side view of the partially constructed device of FIG. 1.3*a* at a later stage of the example fabrication process;

FIG. 1.4*b* is a top view of the partially constructed device shown in FIG. 1.4*a;*

FIG. 1.5*a* is a side view of the partially constructed device of FIG. 1.4*a* at a later stage of the example fabrication process;

FIG. 1.5*b* is a top view of the partially constructed device shown in FIG. 1.5*a;*

FIG. 1.6*a* is a side view of the partially constructed device of FIG. 1.5*a* at a later stage of the example fabrication process;

FIG. 1.6*b* is a top view of the partially constructed device shown in FIG. 1.6*a;*

FIG. 1.6*c* is a photograph of an example partially constructed device prior to heating and the partially constructed device after heating;

FIG. 1.7*a* is a side view of the partially constructed device of FIG. 1.6*a* at a later stage of the example fabrication process;

FIG. 1.7*b* is a top view of the partially constructed device shown in FIG. 1.7*a;*

FIG. 1.8*a* is a side view of the partially constructed device of FIG. 1.7*a* at a later stage of the example fabrication process;

FIG. 1.8*b* is a top view of the partially constructed device shown in FIG. 1.8*a;*

FIG. 1.9*a* is a side view of the partially constructed device of FIG. 1.8*a* at a later stage of the example fabrication process;

FIG. 1.9*b* is a top view of the partially constructed device shown in FIG. 1.9*a;*

FIG. 1.10*a* is a side view of the partially constructed device of FIG. 1.9*a* at a later stage of the example fabrication process;

FIG. 1.10*b* is a top view of the partially constructed device shown in FIG. 1.10*a;*

FIG. 1.11*a* is a side view of the partially constructed device of FIG. 1.10*a* at a later stage of the example fabrication process;

FIG. 1.11*b* is a top view of the partially constructed device shown in FIG. 1.11*a;*

FIG. 1.12*a* is a side view of the partially constructed device of FIG. 1.11*a* at a later stage of the example fabrication process;

FIG. 1.12*b* is a top view of the partially constructed device shown in FIG. 1.12*a;*

FIG. 1.13*a* is a side view of the device constructed from the example fabrication process shown in FIGS. 1.1*a* to 1.12*b;*

FIG. 1.13*b* is a top view of the device shown in FIG. 1.13*a;*

FIG. 2.1*a* is a side view of partially constructed devices at an initial stage of another example fabrication process, in accordance with an example embodiment;

FIG. 2.1*b* is a top view of the partially constructed devices shown in FIG. 2.1*a;*

FIG. 2.2*a* is a side view of the partially constructed devices of FIG. 2.1*a* at a later stage of the example fabrication process;

FIG. 2.2*b* is a top view of the partially constructed devices shown in FIG. 2.2*a;*

FIG. 2.3*a* is a side view of the partially constructed devices of FIG. 2.2*a* at a later stage of the example fabrication process;

FIG. 2.3*b* is a top view of the partially constructed devices shown in FIG. 2.3*a;*

FIG. 2.4*a* is a side view of the partially constructed devices of FIG. 2.3*a* at a later stage of the example fabrication process;

FIG. 2.4*b* is a top view of the partially constructed devices shown in FIG. 2.4*a;*

FIG. 2.5*a* is a side view of the partially constructed devices of FIG. 2.4*a* at a later stage of the example fabrication process;

FIG. 2.5*b* is a top view of the partially constructed devices shown in FIG. 2.5*a;*

FIG. 2.6*a* is a side view of the partially constructed devices of FIG. 2.5*a* at a later stage of the example fabrication process;

FIG. 2.6*b* is a top view of the partially constructed devices shown in FIG. 2.6*a;*

FIG. 2.7*a* is a side view of the partially constructed devices of FIG. 2.6*a* at a later stage of the example fabrication process;

FIG. 2.7*b* is a top view of the partially constructed devices shown in FIG. 2.7*a;*

FIG. 2.8*a* is a side view of the partially constructed devices of FIG. 2.7*a* at a later stage of the example fabrication process;

FIG. 2.8*b* is a top view of the partially constructed devices shown in FIG. 2.8*a;*

FIG. 2.9*a* is a side view of the partially constructed devices of FIG. 2.8*a* at a later stage of the example fabrication process;

FIG. 2.9*b* is a top view of the partially constructed devices shown in FIG. 2.9*a;*

FIG. 2.10*a* is a side view of the partially constructed devices of FIG. 2.9*a* at a later stage of the example fabrication process;

FIG. 2.10*b* is a top view of the partially constructed devices shown in FIG. 2.10*a;*

FIG. 2.11*a* is a side view of the devices constructed from the example fabrication process shown in FIGS. 2.1*a* to 2.10*b;*

FIG. 2.11*b* is a top view of the devices shown in FIG. 2.11*a;*

Figure 3A:
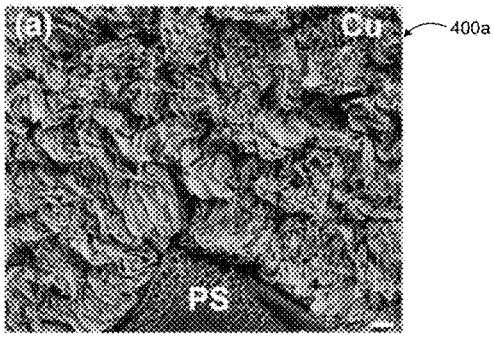
FIG. 3*a* is a partial top view of an example wrinkled conductive element at a low magnification.

The drawings, described below, are provided for purposes of illustration, and not of limitation, of the aspects and features of various examples of embodiments described herein. For simplicity and clarity of illustration, elements shown in the drawings have not necessarily been drawn to scale. The dimensions of some of the elements may be exaggerated relative to other elements for clarity. It will be appreciated that for simplicity and clarity of illustration, where considered appropriate, reference numerals may be repeated among the drawings to indicate corresponding or analogous elements or steps.

DESCRIPTION OF EXAMPLE EMBODIMENTS

Diagnostic tools at point-of-cares and resource-limited environments typically require low power consumption and cost-effective fabrication. Chip-based diagnostic systems, therefore, can be appropriate for point-of-cares and resource-limited environments.

Magnetic separation is often used for detecting diseases and can involve separating functionalized magnetic particles within a biological sample. The magnetic separation process can involve different types of magnetic elements, such as external magnets, on-chip magnetic structures, and/or micro-electromagnets.

Magnetic separation with external magnets can be simple to implement, but on-chip solutions can offer greater design flexibility and improved operation. For example, on-chip solutions can be more scalable than systems that use external magnets, and on-chip solutions can enable increased precision in the manipulation of the magnetic particles.

On-chip magnetic separation devices can be characterized as active, passive or active-passive devices.

Active magnetic separation devices include conductive elements that are capable of carrying current and producing a localized magnetic field and magnetic gradient when current is applied to the conductive element.

An example prior art active magnetic separation device was described in "PCR-Free DNA Detection Using a Magnetic Bead-Supported Polymeric Transducer and Microelectromagnetic Traps" (S. Dubus, J. F. Gravel, B. Le Drogoff, P. Nobert, T. Veres, and D. Boudreau, Anal. Chem. 78, 4457 (2006)). Dubus et al. describe a silicon-based micro-fabricated active electromagnetic device that can trap about 2.8 μm magnetic particles with the application of a 300 mA current for 5 minutes. This device, however, has high current requirements due to its reliance on bulky power supplies and as a result, excessive Joule heating can result.

"On Chip Magnetic Actuator for Batch-Mode Dynamic Manipulation of Magnetic Particles in Compact Lab-On-Chip" (R. Fulcrand, A. Bancaud, C. Escriba, Q. He, S. Charlot, A. Boukabache, and A. M. Gué, Sensors Actuators, B Chem. 160, 1520 (2011)) describes a micro-electromagnetic active device, fabricated on glass or silicon substrate, to trap a batch of 2.8 μm magnetic particles. Magnetic particles in the vicinity of the micro-electromagnet are determined to have a flow rate of 1 μL/min when a current of 80 mA is applied. This active device presented by Fulcrand et al. exhibits a fairly precise control over the movement of the magnetic particles. However, like the device described by Dubus et al., the magnetic field produced by active devices continues to be limited by Joule heating and their power supply requirements since the magnetic field intensity is directly proportional to applied current.

Passive magnetic separation devices include fabricated magnetic structures to induce localized magnetic field gradients when magnetized by an external magnetic field. The magnetic structures can be microscale or nanoscale ferromagnetic structures.

In "Continuous Microfluidic Immunomagnetic Cell Separation" (D. W. Inglis, R. Riehn, R. H. Austin, and J. C. Sturm, Appl. Phys. Lett. 85, 5093 (2004)), Inglis et al. describe a passive silicon device with micro-fabricated nickel strips to induce lateral forces on magnetic particles for continuous cell-by-cell separation from a flow stream in microfluidic channels.

In "Characterization of A Microfluidic Magnetic Bead Separator for High-Throughput Applications" (M. Bu, T. B. Christensen, K. Smistrup, A. Wolff, and M. F. Hansen, Sensors Actuators A Phys. 145-146, 430 (2008)), Bu et al. describe a Pyrex-based micro-fabricated passive magnetic separation platform. The platform includes a series of permanent magnets placed in a checkerboard pattern with alternating magnetization directions and an array of magnetized patterned permalloy to capture about 250 nm magnetic beads in a continuous flow.

Although these passive devices are relatively simple to implement, both require magnetization by an external magnet, which can restrict the extent of automation and controllability that may be possible, especially for chip-based biosensors.

In "A New Magnetic Bead-Based, Filterless Bio-Separator with Planar Electromagnet Surfaces for Integrated Bio-Detection Systems" (J. Choi, C. H. Ahn, S. Bhansali, and H. T. Henderson, Sensors and Actuators 68, 34 (2000)), Choi et al. describe an active-passive magnetic separation device. The device includes planar electromagnets that are semi-encapsulated in permalloy for separating magnetic particles through the application of a relatively small DC current of 30 mA. The active-passive magnetic separation device described by Choi et al. is fabricated using complex and expensive lithographic techniques. Like the other prior art devices, the device described by Choi et al. is also fabricated using complex and expensive lithographic techniques, which are not suitable for low-volume and mid-volume manufacturing.

A rapid prototyping method for fabricating a passive separation device is described in "Shrink-Induced Sorting Using Integrated Nanoscale Magnetic Traps" (D. Nawarathna, N. Norouzi, J. McLane, H. Sharma, N. Sharac, T. Grant, A. Chen, S. Strayer, R. Ragan, and M. Khine, Appl. Phys. Lett. 102, 63504 (2013)). The passive device has micro-textured and nano-textured nickel structures on commercially-available shrink-wrap polyolefin films to sort 1 μm magnetic particles from non-magnetic beads. However, the fabrication process described by Nawarathna et al. is for a passive magnetic separation device.

In comparison with active and passive devices, active-passive magnetic separation devices can operate at lower current and can also offer more precise magnetic separation. Reference will now be made to FIGS. 1.1*a* to 1.13*b*, which illustrate various stages in an example fabrication process of an example magnetic separation device 50.

FIG. 1.1*a* is a side view 10*s* of a substrate 100 at an initial stage of an example fabrication process of the magnetic separation device 50. FIG. 1.1*b* is a top view 10*t* of the substrate 100 shown in FIG. 1.1*a*.

The substrate 100 can be formed of a polymer material, such as pre-stressed polystyrene (PSPS), polyolefin, polyethylene films or other similar materials. The polymer material can be formed of a shrinkable polymer, in some embodiments. Use of a shrinkable polymer in the substrate 100 can facilitate the wrinkling effect described herein. In the example shown in FIGS. 1.1*a* and 1.1*b*, the substrate is a cleaned pre-stressed polystyrene sheet.

FIG. 1.2*a* is a side view 12*s* of the substrate 100 layered with a mask 102, and FIG. 1.2*b* is a top view 12*t* of the substrate 100 layered with the mask 102. The mask 102 in this example is formed of a self-adhesive vinyl material. In some embodiments, shadow masks can be used. The shadow masks may be made with lithographically-patterned photoresist or other thin films, or from bulk substrates, such as, but not limited to, aluminum or stainless steel.

A portion of the mask 102 can be removed for defining a pattern in the mask 102. The portion of the mask 102 can be removed with a craft cutter, such as a robotic craft cutter. FIG. 1.3*b* shows a top view 14*t* of the mask 102 with a pattern 120 (e.g., formed by removing the portion of the mask 102), and FIG. 1.3*a* shows a side view 14*s* of the patterned mask 102' on the substrate 100.

As shown in FIG. 1.3*b*, the pattern 120 formed by removing the portion of the mask 102 can have a meandering design. The meandering design may be mesh-shaped. In the example shown, a smallest feature size of the mesh-shaped meandering design 120 is 400 μm. In comparison with other geometries, such as planar geometries or rosette geometries, Ramadan et al. describes in "On-Chip Micro-Electromagnets for Magnetic-Based Bio-Molecules Separation" (Q. Ramadan, V. Samper, D. Poenar, and C. Yu, J. Magn. Magn. Mater. 281, 150 (2004)) that the mesh-shaped meandering design 120 can enhance the generated magnetic flux density (B). Ramadan et al. determined that the semi-looped structure of the mesh-shaped meandering design 120 can intensify the perpendicular component of magnetic flux density B.

After defining the pattern 120 in the mask 102, a conductive material 104 can be deposited onto the patterned mask 102'. FIGS. 1.4*a* and 1.4*b* show a side view 16*s* and a top view 16*t*, respectively, of the patterned mask 102' with a conductive material 104 deposited thereon. In some embodiments, the conductive material 104 can be deposited onto the mask 102 via physical vapour deposition, chemical vapour deposition, electrodeposition, electroless deposition, or self-assembly.

The conductive material 104 can include various metals, such as copper, titanium, titanium oxide, titanium nitride, tungsten, aluminum, chromium, or noble metals. In the example shown in FIGS. 1.4*a* and 1.4*b*, the conductive material 104 is a thin copper film sputtered onto the patterned mask 102'. The thin copper film 104 can have a thickness of about 100 nm, for example.

When the patterned mask 102' is removed, a conductive element 122 is formed on the substrate 100, as shown in FIG. 1.5*b*. FIG. 1.5*b* is a top view 18*t* of the substrate 100 with the conductive element 122 formed thereon and FIG. 1.5*a* shows a side view 18*s* of the substrate 100 with the conductive element 122 formed thereon.

Reducing the geometries of the conductive element 122, such as a width of the conductive element 122 and the spacing within the conductive element 122, can increase a magnetic field strength and a magnetic field gradient in the direction perpendicular to the reduced geometry. The relationship between the geometry of the conductive element 122 and the magnetic properties are described with reference to FIGS. 12*a* to 14*c*.

The substrate 100 with the conductive element 122 formed thereon is heated. As a result of the heating, the substrate 100 shrinks. The stress caused by the shrinking of the substrate 100 can cause the conductive element 122 to wrinkle while also maintaining its pattern.

FIGS. 1.16*a* to 1.16*b* show the side and top views 20*s* and 20*t*, respectively, of a shrunk substrate 100' and wrinkled conductive element 122'. For comparison purposes, FIG. 1.16*c* shows the partially constructed device before shrinking (at 18*t*) and after shrinking (at 20*t*). In the example fabrication process shown in FIGS. 1.1*a* to 1.13*b*, the copper-coated substrate 100' was heated for about 3 minutes at 150 to 160° C. Heating pre-stressed polystyrene above the glass transition temperature of 100° C. can cause the polystyrene to shrink to under 50% of its original size due to polymer chain relaxation.

Due to thermal shrinking, the electrode width and inter-electrode spacing can be reduced while a height of the conductive element 122 can be increased. Also, the sheet resistance of conductive thin films (e.g., films having a thickness of approximately 100 nm or less) tends to decrease after the wrinkling process due to an increase in the effective height of the conductive element 122.

In some cases, the thickness of the conductive element 122 can be increased up to 20 μm. This can be referred to as wrinkling of the conductive element 122. Ramadan et al. also reported that reducing the width of the conductive element 122 while keeping the thickness relatively unchanged can strengthen the magnetic field gradient component that is perpendicular to the width of the conductive element 122. The dimensions and geometries of the conductive element 122, therefore, can vary the magnetic properties. Various dimensions for the devices will be described with reference to FIGS. 2.3*a* to 2.11*b*.

The introduction of micro-texturing and/or nano-texturing to the surface of the conductive element 122 through thermal shrinking can result in three-dimensional structures without needing to resort to time-consuming and expensive fabrication techniques, such as direct metal deposition.

Figure 3B:
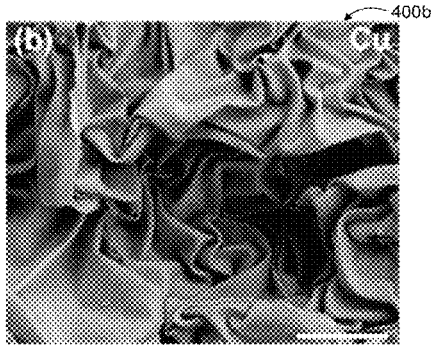
FIG. 3*b* is a partial top view of the example wrinkled conductive element shown in FIG. 3*a* at a high magnification.
Figure 3C:
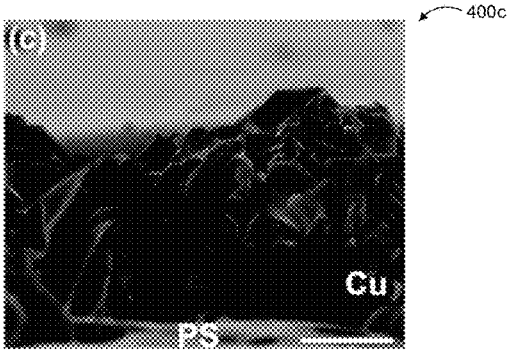
FIG. 3*c* is a partial side view of the example wrinkled conductive element shown in FIG. 3*a* at a high magnification.

FIGS. 3*a* to 3*c* are various views of an example wrinkled conductive element 122'.

FIG. 3*a* is a partial top view 400*a* of the example wrinkled conductive element 122' at a low magnification. FIG. 3*b* is a partial top view 400*b* of the example wrinkled conductive element 122' at a high magnification. FIG. 3*c* shows a partial side-view 400*c* of the example wrinkled conductive element 122' at high magnification.

The views 400*a* to 400*c* in FIGS. 3*a* to 3*c* were captured using Scanning Electron Microscopy (SEM). The example wrinkled conductive element 122' shown in FIGS. 3*a* to 3*c* has a width of approximately 130 μm to 140 μm and a thickness of approximately 20 μm. As shown in FIGS. 3*a* to 3*c*, the repeating hills and valleys represent the micro-texturing and/or nano-texturing that result at the surface of the conductive element 122' after undergoing thermal shrinking.

Figure 5A:
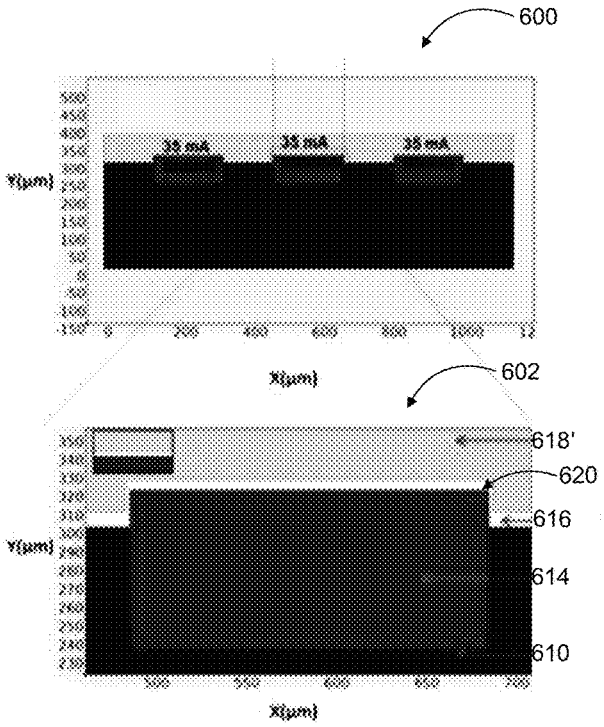
FIG. 5*a* is a cross-sectional schematic drawing of a prior art device.
Figure 6A:
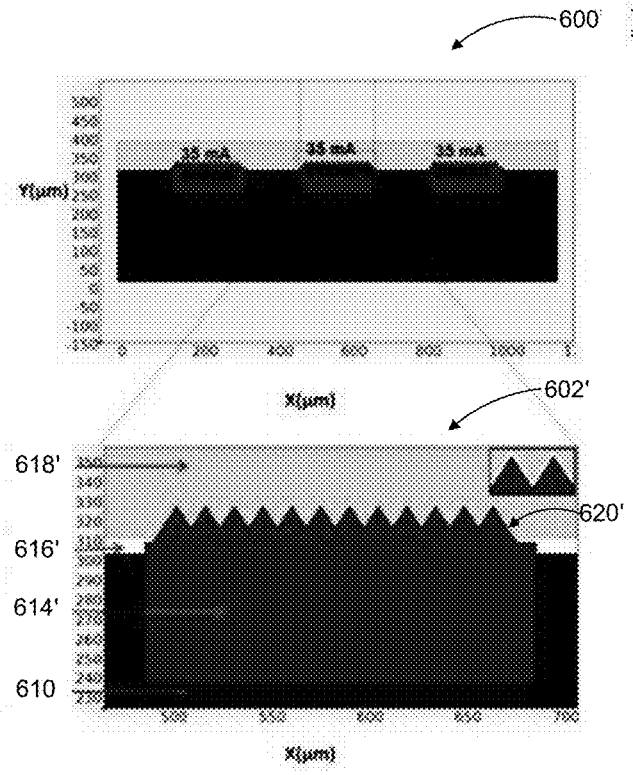
FIG. 6*a* is a cross-sectional schematic drawing of an example device, in accordance with an example embodiment.

To illustrate the effects that wrinkling has on the magnetic properties of the devices, a device 600 with a conductive layer 614 having a flat surface 620 is modelled in FIG. 5*a* and a device 600' with a conductive layer 614' having a wrinkled surface 620' is modelled in FIG. 6*a*.

As shown in FIG. 5*a*, and more clearly in the exploded view 602 of a portion of the device 600, the device 600 includes a substrate 610 on which a conductive layer 614 is provided. The conductive layer 614 can be formed of a conductive material, such as copper. On the conductive layer 614 is an insulating layer 616. A channel 618 illustrating the fluid surrounding the device 600 is shown on the insulating layer 616. The device 600' in FIG. 6*a* also includes the substrate 610 but the surface 620' of the conductive layer 614' is wrinkled. As shown in the exploded view 602', each of the insulating layer 616' and the channel 618' is formed with respect to the wrinkled surface 620'.

The devices 600 and 600' modelled in respective FIGS. 5*a* and 6*a* are simulated to study various magnetic properties, such as the magnetic field strength (|H|), magnetic gradient ($|\nabla \vec{B}|$), and magnetic force ($F_y$), in respect of 2.8 μm of magnetic particles when a current of 35 mA is applied. The magnetic force ($F_y$) can be determined from Equation (1), below, which is derived from the Maxwell tensor equation:

$$\overrightarrow{F_{mag}} = \frac{V\Delta\chi}{\mu_0}(\vec{B}\cdot\nabla)\vec{B} \quad (1)$$

where $\overrightarrow{F_{mag}}$ is the magnetic force exerted on each particle, V is the particle volume, $\Delta\chi$ is the effective magnetic susceptibility of the particle relative to the surrounding medium, $\vec{B}$ is the magnetic flux density, $\nabla\vec{B}$ is the magnetic field gradient, and $\mu_0$ is the permeability of free space. For simplicity, the magnetic force ($F_y$) studied in respect of the devices 600 and 600' is limited to the y-direction. A magnetic force ($F_y$) with a negative value indicates an attractive magnetic force towards a surface 620, 620' of the respective device 600, 600'. Also, in these examples, $\Delta\chi$ has a value of 0.17.

Figure 5B:
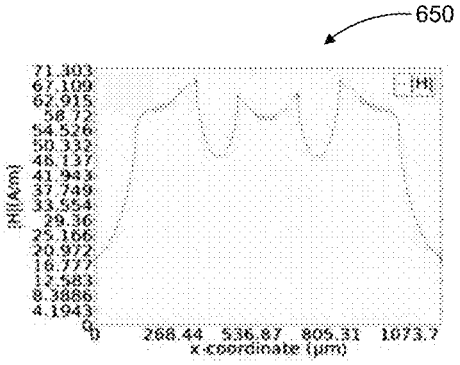
FIG. 5*b* is a plot of a magnetic force of the prior art device shown in FIG. 5*a;*
Figure 5C:
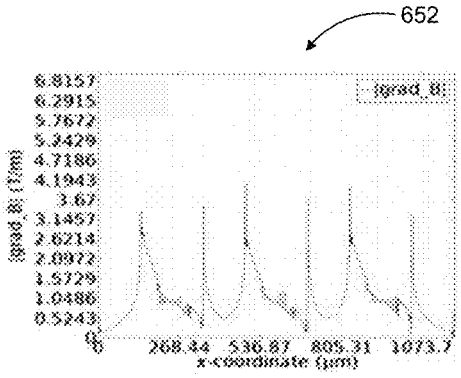
FIG. 5*c* is a plot of a magnetic gradient of the prior art device shown in FIG. 5*a;*
Figure 5D:
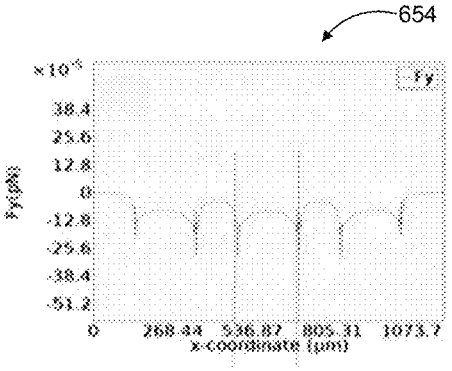
FIG. 5*d* is a plot of a magnetic field strength of the prior art device shown in FIG. 5*a;*

FIG. 5*b* is a plot 650 of the magnetic field strength (|H|) after the current of 35 mA is applied to the device 600, FIG. 5*c* is a plot 652 illustrating the magnetic gradient ($|\nabla\vec{B}|$) after the current of 35 mA is applied to the device 600, and FIG. 5*d* is a plot 654 illustrating the magnetic force ($F_y$) after the current of 35 mA is applied to the device 600.

Figure 6B:
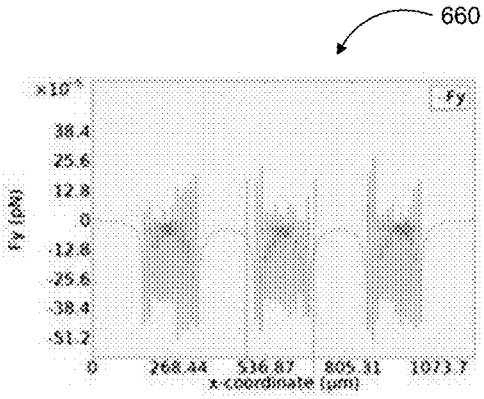
FIG. 6*b* is a plot of a magnetic force of the device shown in FIG. 6*a;*
Figure 6C:
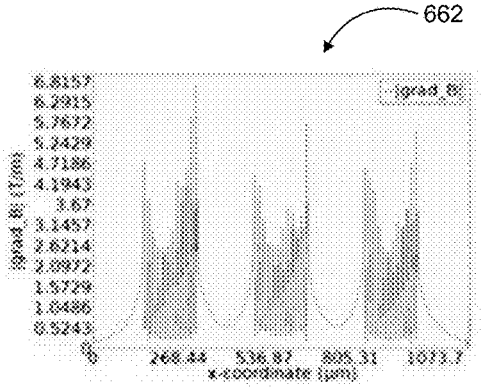
FIG. 6*c* is a plot of a gradient of the device shown in FIG. 6*a;*

FIG. 6*b* is a plot 660 of the magnetic field strength (|H|) after the current of 35 mA is applied to the device 600', FIG. 6*c* is a plot 662 illustrating the magnetic gradient ($|\nabla\vec{B}|$) after the current of 35 mA is applied to the device 600', and FIG. 5*d* is a plot 664 illustrating the magnetic force ($F_y$) after the current of 35 mA is applied to the device 600'.

Figure 6D:
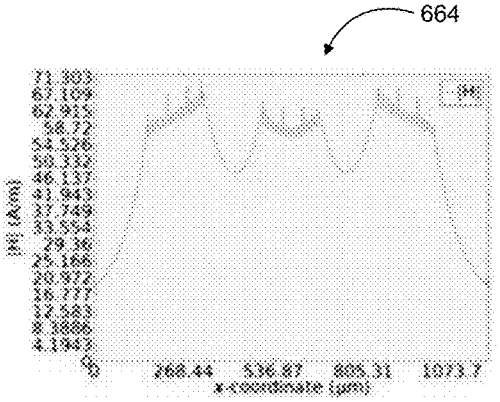
FIG. 6*d* is a plot of a magnetic field strength of the device shown in FIG. 6*a;*

In comparing the plots 650, 652 and 654 shown in FIGS. 5*b* to 5*d* with the plots 660, 662 and 664 shown in FIGS. 6*b* to 6*d*, it can be seen that the magnetic properties are enhanced at the edges of the wrinkles of the device 600'. For example, although the magnetic field strength (|H|) in the plot 660 shows a slight increase at the tips of the wrinkles in comparison with the plot 650, the magnetic gradient ($|\nabla\vec{B}|$) and the magnetic force ($F_y$) in the respective plots 662 and 664 appear to be approximately three times higher than the magnetic gradient ($|\nabla\vec{B}|$) and the magnetic force ($F_y$) in the respective plots 652 and 654.

From the simulation results of the devices 600 and 600', it can be seen that an enhanced local magnetic force at the edges of the wrinkled surface 620' and of micro- and nano-structures having a high aspect ratio, is due, at least, to the higher field gradient closer to sharp and narrow regions of these structures.

From FIGS. 5*b* to 5*d* and 6*b* to 6*d*, it can be seen that the wrinkled conductive element 122' can generate a magnetic force that is enhanced since the regions near the edges of the wrinkles, in particular the sharp and narrow points in the wrinkles, are typically associated with a higher magnetic field gradient.

Continuing now with reference to FIGS. 1.7*a* and 1.7*b*, which are side and top views 22*s* and 22*t*, respectively. As shown in FIGS. 1.7*a* and 1.7*b*, an insulating layer 106 is coated onto a surface of the wrinkled conductive element 122' and the substrate 100'. The insulating layer 106 can isolate the wrinkled conductive element 122' from the magnetic element to be formed thereon to act as the passive component of the magnetic separation device 50. The magnetic element can enhance the magnetic force at a given current.

In the example illustrated in FIGS. 1.7*a* and 1.7*b*, a layer of negative photoresist (e.g., SU-8 2007) is provided onto the wrinkled conductive element 122' and the substrate 100'. The negative photoresist can be spun onto the wrinkled conductive element 122' and the substrate 100' to form the insulating layer 106. The insulating layer 106 is then baked at 95° C. for 15 minutes. The thickness of the insulating layer 106 can also be selected to maximize the magnetic force while eliminating inter-metallic current leakage. The insulating layer 106 has a thickness of 25 μm, for example.

The insulating layer 106 can be formed with one or more different materials, such as photoresists (e.g., SU-8), polydimethylsiloxane, silicon dioxide, silicon nitride, nitrogen doped silicon oxide, and parylene or combinations thereof. SU-8 2007 has a relatively low baking temperature (approximately 95° C.) and therefore, SU-8 2007 can be a suitable material in the fabrication of devices involving polymeric substrates.

Another mask 108 is then provided onto the insulating layer 106, as shown in FIGS. 1.8*a* and 1.8*b*. The mask 108 can be formed of a self-adhesive vinyl material. In some embodiments, the mask 108 can be a shadow mask that is made from lithographically-patterned photoresist or other thin films (e.g., silicon dioxide or silicon nitride), or made from bulk substrates, such as, but not limited to, aluminum or stainless steel.

In FIGS. 1.9*a* and 1.9*b*, a conductive material 110 is then deposited onto the mask 108. The conductive material 110 can be formed from various materials, such as silver, copper, titanium, titanium oxide, titanium nitride, tungsten, aluminum, chromium, or noble metals. The mask 108 can then be removed so that the conductive material 110 forms a conductive seed layer 110', which is shown in FIGS. 1.10*a* and 1.10*b*. The conductive seed layer 110' can facilitate the formation of the magnetic element.

In some embodiments, the mask 108 can be removed through a lift-off process.

To prepare for the formation of the magnetic element, a mask 112 can be provided onto the conductive seed layer 110'. Similar to the masks 102 and 108, the mask 112 can be formed of a self-adhesive vinyl material or lithographically-patterned photoresist or other thin films, such as silicon dioxide or silicon nitride.

The magnetic element can be fabricated via electrodeposition or electroless deposition of various magnetic materials, such as nickel, iron, permalloy, supermalloy, mu-metal, cobalt-iron alloys, and other nickel-iron alloys or combinations thereof. In the example illustrated in FIGS. 1.11*a* to 1.13*b*, the magnetic element is fabricated via electrodeposition of permalloy.

The mask 112 can define an area for electrodeposition onto the conductive seed layer 110'. The example area defined by the mask 112 in FIGS. 1.11*a* and 1.11*b* is approximately 10 mm by 1.2 mm. It will be understood that the area for the electrodeposition of the conductive seed can be defined with a verity of patterns and/or dimensions.

The thickness of the electrodeposited permalloy 114 in the example shown in FIGS. 1.12*a* and 1.12*b* is approximately around 60 nm, which is calculated based on the total electronic charge transferred during electrodeposition.

In some embodiments, the electrodeposition process can involve chronopotentiometry. For example, the chronopotentiometry process can be performed at a current density of approximately 5 mA/cm$^2$ for 44 s in a three-electrode electrochemical cell with an electrodeposition bath composed of 0.95M $NiSO_4.6H_2O$, 18 mM $FeSO_4.7H_2O$, 0.4M $H_3B0_3$; 4.87 mM sodium saccharin, and 0.35 mM sodium dodecyl sulfate. The composition of the electrodeposition bath is so defined to provide a uniform magnetic layer (of permalloy) at a composition of $Ni_{80}/Fe_{20}$.

By removing the mask 112, a magnetic separation device 50 that can be operated for manipulating magnetic particles results. FIG. 1.13*a* shows a side view 34*s* of the device 50 and FIG. 1.13*b* shows a top view 34*t* of the device 50.

FIGS. 2.1*a* to 2.11*b* illustrate an example fabrication process of multiple magnetic separation devices, which is generally shown at 60 in FIG. 2.11*b*. To minimize fabrication time, the fabrication process shown with FIGS. 2.1*a* to 2.11*b* produces multiple magnetic separation devices 60 on a substrate 300. The substrate 300, similar to the magnetic separation device 50 resulting from the fabrication process described with reference to FIGS. 1.1*a* to 1.13*b*, is a sheet formed of pre-stressed polystyrene.

The fabrication process illustrated with FIGS. 2.1*a* to 2.11*b* is generally similar to that shown with FIGS. 1.1*a* to 1.13*b*. The substrate 300 is provided (FIG. 2.1*a* shows a side view 200*s* and FIG. 2.1*b* shows a top view 200*t*) and a mask 302 is provided thereon (see FIGS. 2.2*a* and 2.2*b*).

Unlike the fabrication process described with reference to FIGS. 1.3*a* and 1.3*b*, three patterns of different geometries are defined in the mask 302 in the fabrication stage shown in FIGS. 2.3*a* and 2.3*b*. As can be more clearly shown in FIGS. 2.5*b* and 20*a* to 20*d*, the geometry of the pattern 320*a* in the devices at edges 62 and 64 have a width of 200 μm and a spacing of 200 μm, the geometry of the pattern 320*b* in the devices at edge 66 have a width of 400 μm and a spacing of 200 μm, and the geometry of the pattern 320*c* in the devices at edge 68 have a width of 400 μm and a spacing of 400 μm.

FIGS. 2.3*a* and 2.3*b* show a side view 204*s* and atop view 204*t*, respectively, of the patterned mask 302'. Also, as shown in FIG. 2.3*b*, an opening 301 is defined in the patterned mask 302' and the substrate 300.

Similar to FIGS. 1.4*a* and 1.4*b*, a conductive material 304 is deposited onto the patterned mask 302' at the stage shown in FIGS. 2.4*a* and 2.4*b*. FIGS. 2.5*a* and 2.5*b* show a side view 208*s* and a top view 208*t*, respectively, of the conductive elements 322*a*, 322*b* and 322*c* formed thereon when the patterned mask 302' is removed.

Like the fabrication stage described with reference to FIGS. 1.6*a* and 1.6*b*, the partially constructed devices formed in FIGS. 2.5*a* and 2.5*b* are now heated. As shown in FIGS. 2.6*a* and 2.6*b*, the substrate 300 and the conductive elements 322*a*, 322*b* and 322*c* are laterally shrunk by approximately 40% of its original size while the height is increased by approximately 625% due to polymer chain relaxation. For example, after heating, the dimensions of the conductive element 322*a* is reduced to a width of 100 μm and a spacing of 70 μm, the dimensions of the conductive element 322*b* is reduced to a width of 190 μm and a spacing of 140 μm, and the dimensions of the conductive element 322*c* is reduced to a width of 190 μm and a spacing of 60 μm. The dimension reductions are disproportional at the conductive elements 322*a* to 322*c*. The disproportionality is due, in part, to the material properties of the conductive material 304 and the substrate 300. For example, there is a discrepancy between the stiffness of copper, which is used as the conductive material 304 in the example, and the stiffness of the pre-stressed polystyrene.

In FIGS. 2.7*a* and 2.7*b*, an insulating layer 306 is deposited onto the partially constructed devices shown in FIGS. 2.6*a* and 2.6*b*. The insulating layer 306 can be formed of SU-8 2007. Like the insulating layer 106, the insulating layer 306 can be formed with one or more different materials, such as photoresists (e.g., SU-8), polydimethylsiloxane, silicon dioxide, silicon nitride, nitrogen doped silicon oxide, and parylene or combinations thereof. The insulating layer 306 has a thickness of 20 μm, for example.

To form a conductive seed layer 310', a mask 308 is provided onto the insulating layer 306 (FIGS. 2.8*a* and 2.8*b*). The mask 308 can be formed of a self-vinyl material. The mask 308 defines an area for electrodeposition of the magnetic material (e.g., permalloy), as well as conductive paths to the opening 301'. The opening 301' can be used during the electroplating stage to connect a micro-hook to the magnetic material supply.

A conductive material 310, such as any one or more of silver, copper, titanium, titanium oxide, titanium nitride, tungsten, aluminum, chromium, or noble metals, is then deposited onto the mask 308 (FIGS. 2.9*a* and 2.9*b*). The mask 308 is removed (as shown in FIGS. 2.10*a* and 2.10*b*) to result in the conductive seed layer 310'.

FIG. 2.11*a* shows a side view 220*s* of the magnetic separation devices 60 after the magnetic layer 312 is electroplated thereon. FIG. 2.11*b* shows a top view 220*t* of the magnetic separation devices 60.

Figure 4:
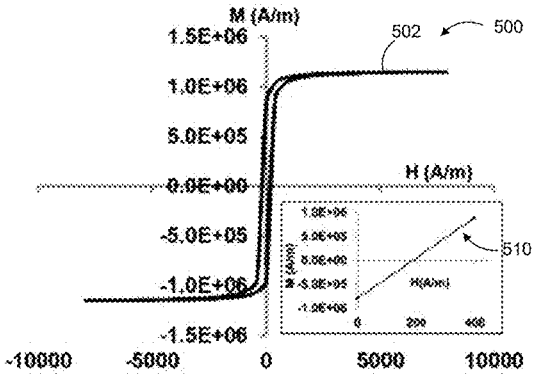
FIG. 4 is an example plot showing the magnetization properties of various example devices.

FIG. 4 is an example plot 500 of a hysteresis curve 502 representative of the magnetization properties of various example magnetic separation devices. A plot 510 illustrating the linear portion of the hysteresis curve 502 is also shown in FIG. 4. The magnetic layer represented in the plot 500 is formed of electrodeposited permalloy.

To understand the magnetic properties of the electrodeposited permalloy, energy-dispersive X-ray spectroscopy (EDX) can be used to identify its composition. The plot 500 includes data obtained from measuring the permalloy composition of three different samples and determined an average value of approximately 85% nickel and approximately 15% iron.

From the plot 500, a saturation magnetization ($M_s$) can be estimated to be approximately 1150 emu/cm$^3$, which is consistent with the tabled values for permalloy. According to the relationship shown in Equation (2), below:

$$\mu_r = \frac{M}{H} + 1 \tag{2}$$

the relative permeability ($\mu_r$) can be estimated to be approximately 4000 using the plot 510.

The relative permeability μr is relatively high, which provides a magnetic flux linkage that can strengthen the generated magnetic flux density, which is desirable for trapping magnetic particles.

The coercivity ($H_c$) of the electrodeposited permalloy can also be calculated from the plot 500 and is approximately 192 A/m, which is a relatively low coercivity value. A low coercivity value can facilitate trapping and releasing magnetic particles by modulating the current passing through the conductive elements 122, 322.

FIGS. 7*a* to 7*d* are perspective views of different devices 700*a* to 700*d*, respectively, with a conductive element formed in a pattern 720. The pattern 720, as shown, has a meandering design. From simulations of the devices 700*a* to 700*d* shown in FIGS. 7*a* to 7*d*, the different magnetic properties associated with active devices and active-passive devices can be illustrated.

Figure 7A:
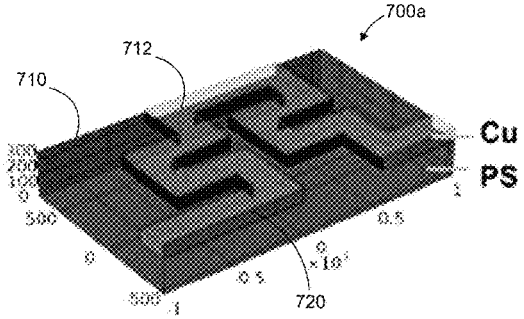
FIG. 7*a* is a perspective view of an example device.
Figure 7C:
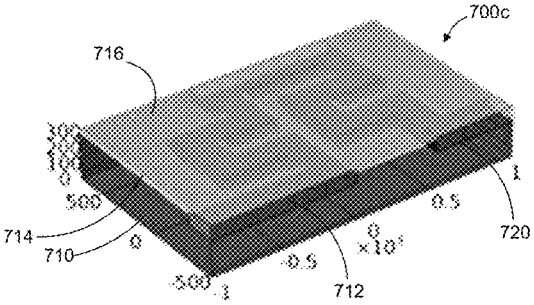
FIG. 7*c* is a perspective view of yet another example device.
Figure 7B:
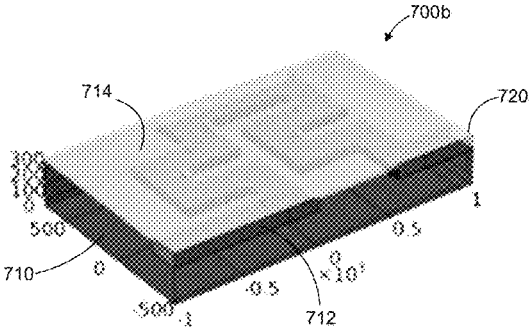
FIG. 7*b* is a perspective view of another example device.
Figure 7D:
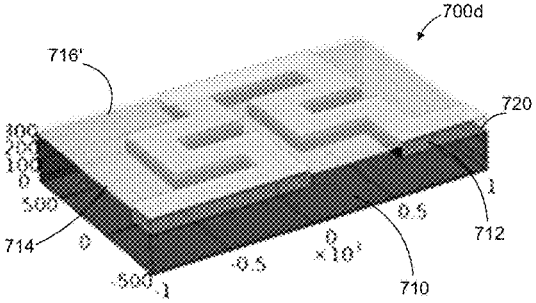
FIG. 7*d* is a perspective view of yet another example device.

In FIG. 7*a*, the device 700*a* includes a substrate 710 on which a conductive element 712 is formed in the pattern 720. The device 700*b* shown in FIG. 7*b* is the device 700*a* covered with an insulation layer 714 (e.g., SU-8). FIG. 7*c* shows a device 700*c* that is composed of the device 700*b* but covered with a magnetic layer 716. The magnetic layer 716 is rectangular in shape and is formed of a permalloy material. Device 700*d* is similar to device 700*c* except the magnetic layer 716' is also formed in the pattern 120, which is then aligned with the conductive element 712. The patterned magnetic layer 716' is arranged so that its edges are aligned with the corresponding edges of the conductive element 712 located underneath.

Each of the devices 700*a* to 700*d* is simulated to study their magnetic properties, namely magnetic field strength ($|H|$), magnetic gradient ($|\nabla\vec{B}|$), and magnetic force ($|F|$), at their respective surfaces. Similar to the simulation results shown in the plots of FIGS. 5*b* to 5*d* and 6*b* to 6*d*, a current of 35 mA is applied to the devices 700*a* to 700*d* to generate heat maps to study the various magnetic properties in respect of 2.8 μm of magnetic particles when a current of 35 mA is applied.

Figure 8A:
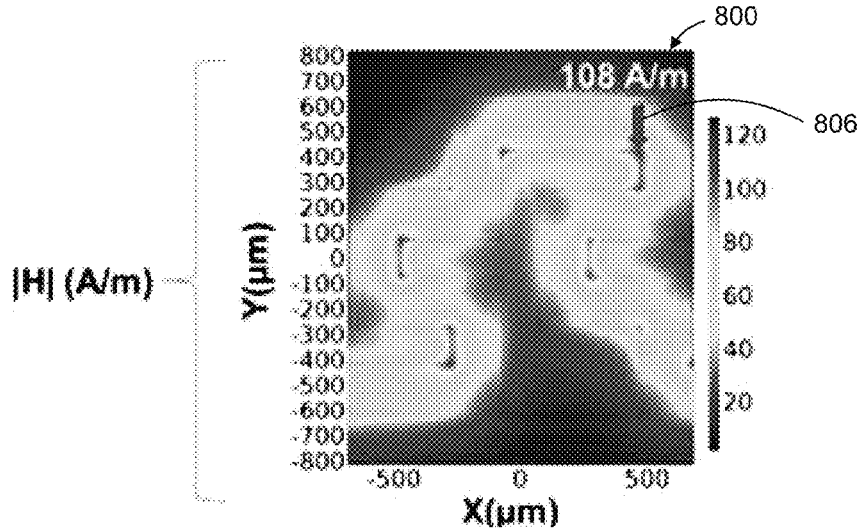
FIG. 8*a* is a heat map representing a magnetic field strength of the example device shown in FIG. 7*a;*
Figure 8B:
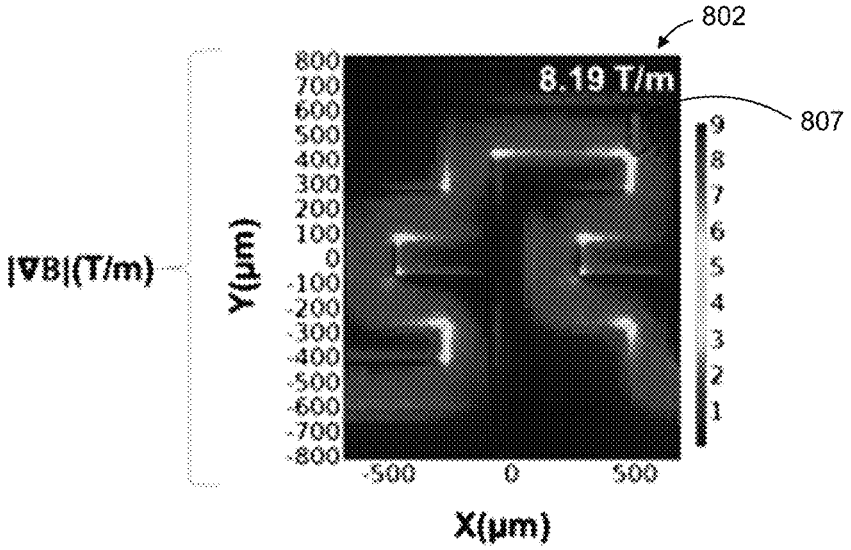
FIG. 8*b* is a heat map representing a magnetic gradient of the example device shown in FIG. 7*a;*
Figure 8C:
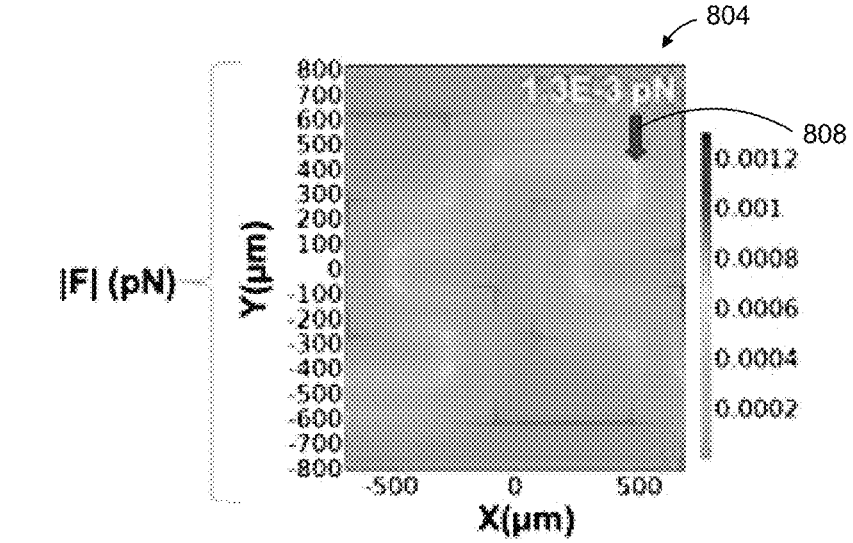
FIG. 8*c* is a heat map representing a magnetic force of the example device shown in FIG. 7*a;*

FIGS. 8*a* to 8*c* show heat maps 800, 802 and 804, respectively, of the magnetic field strength ($|H|$), the magnetic gradient ($|\nabla\vec{B}|$), and the magnetic force ($|F|$) after the current is applied to the example device 700*a*. The heat maps 800, 802 and 804 show a higher magnetic field strength, a higher magnetic gradient and a higher magnetic force is generated inside the loop structure of the pattern 720 in comparison with the rest of the structure. The strengthened magnetic properties within the loop structure are expected since the magnetic field components add constructively within this region.

An arrow 806, 807, 808 is shown in each of the respective heat maps 800, 802 and 804 to identify a specific region within the loop structure of the pattern 720. Arrows 806, 807, and 808 continue to be included in the heat maps shown in FIGS. 9*a* to 14*c* for comparison between the devices 700*a* to 700*d*.

Figure 9A:
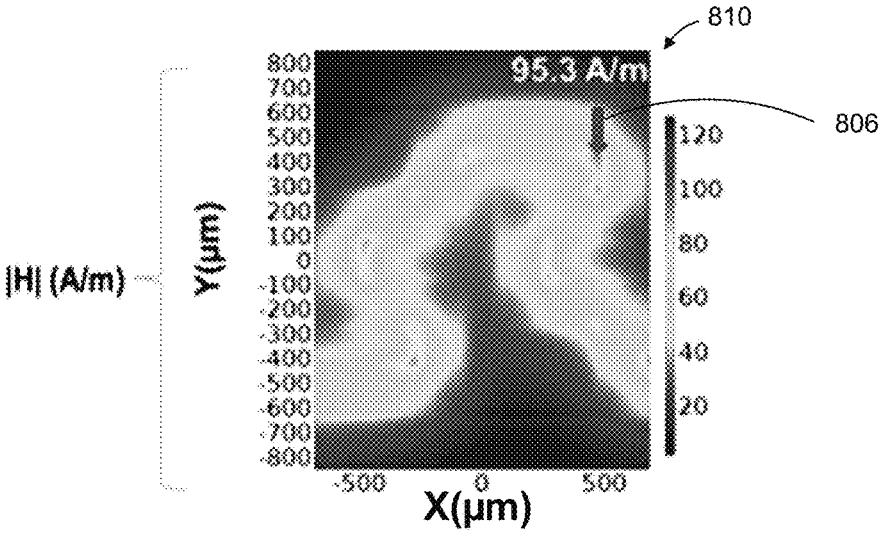
FIG. 9*a* is a heat map representing a magnetic field strength of the example device shown in FIG. 7*b;*
Figure 9B:
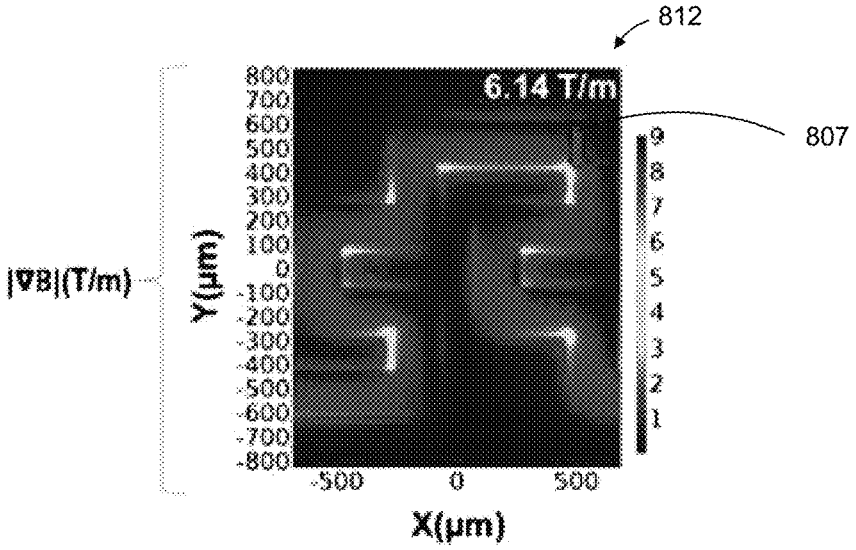
FIG. 9*b* is a heat map representing a magnetic gradient of the example device shown in FIG. 7*b;*
Figure 9C:
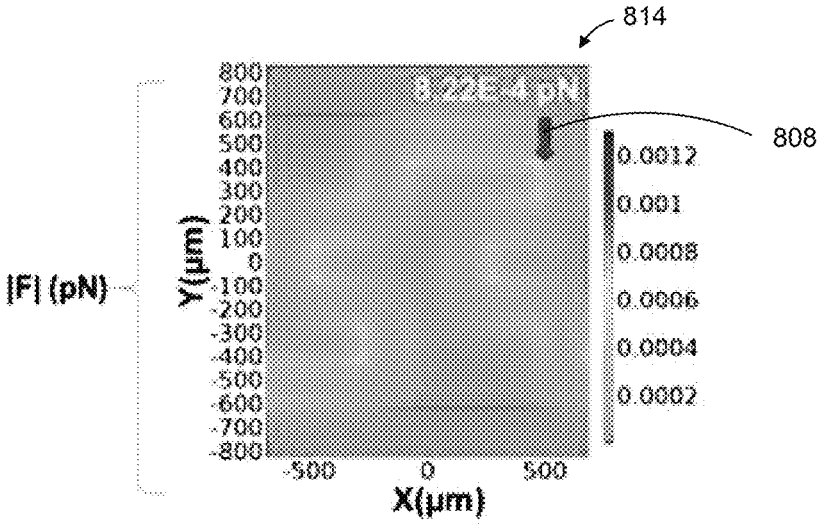
FIG. 9*c* is a heat map representing a magnetic force of the example device shown in FIG. 7*b;*

FIGS. 9*a* to 9*c* show heat maps 810, 812 and 814, respectively, of the magnetic field strength ($|H|$), the magnetic gradient ($|\nabla\vec{B}|$), and the magnetic force ($|F|$) after the current is applied to the example device 700*b*. With the addition of the insulation layer 714, the heat maps 810, 812 and 814 show a slight decrease in the magnetic field strength, the magnetic gradient and the magnetic force. This decrease is expected as the magnetic field strength deceases rapidly with increasing distance from the surface of the conductive element 712.

Figure 10A:
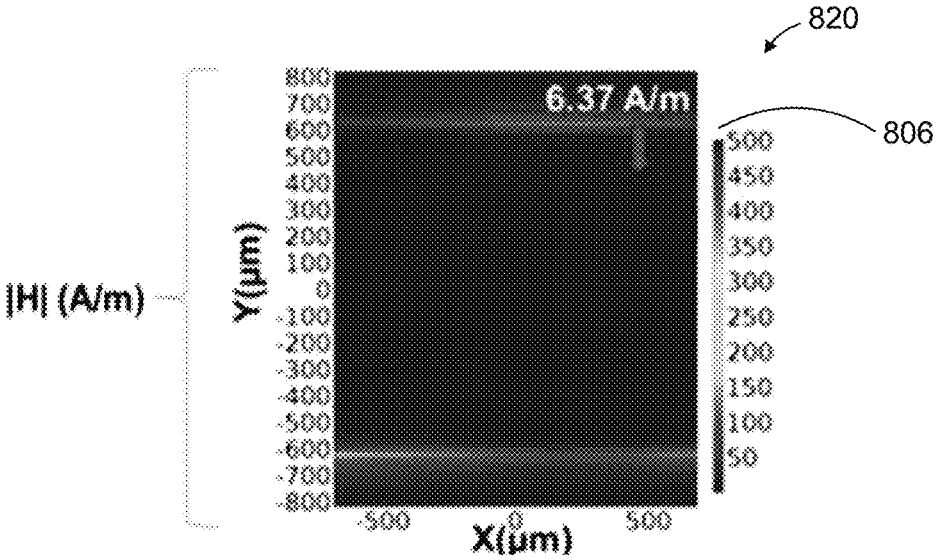
FIG. 10*a* is a heat map representing a magnetic field strength of the example device shown in FIG. 7*c;*
Figure 10B:
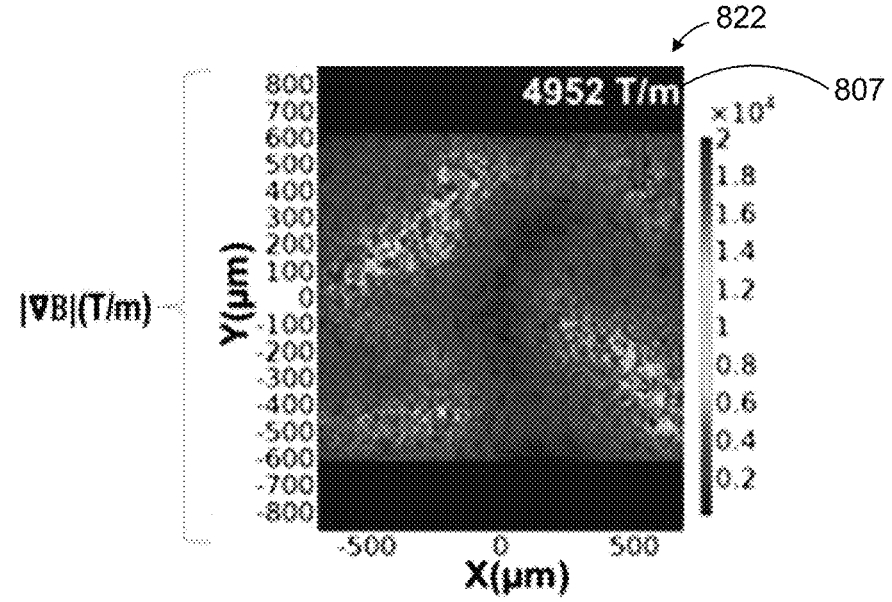
FIG. 10*b* is a heat map representing a magnetic gradient of the example device shown in FIG. 7*c;*
Figure 10C:
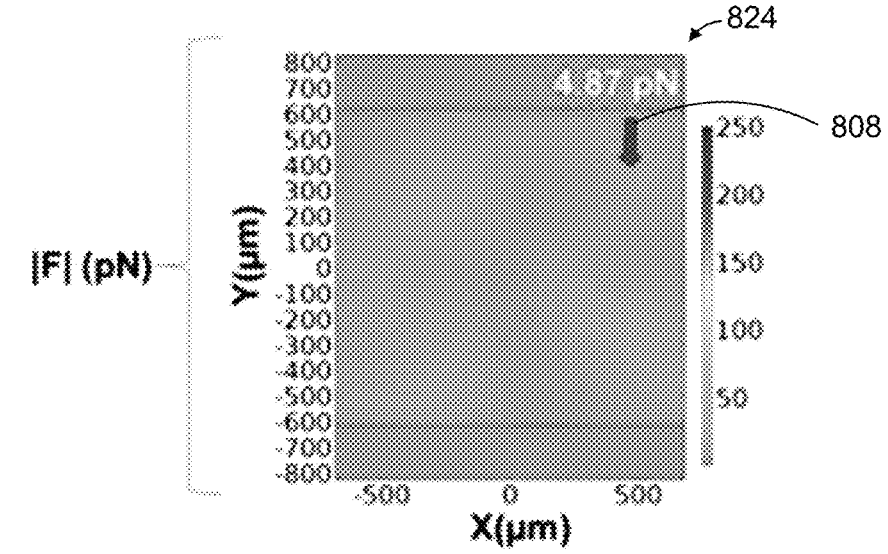
FIG. 10*c* is a heat map representing a magnetic force of the example device shown in FIG. 7*c;*

FIGS. 10*a* to 10*c* show heat maps 820, 822 and 824, respectively, of the magnetic field strength ($|H|$), the magnetic gradient ($|\nabla\vec{B}|$), and the magnetic force ($|F|$) after the current is applied to the example device 700*c*. With the addition of the rectangular magnetic layer 716, the heat map 820 shows a decrease in the magnetic field strength near the middle region of the magnetic layer 716 and an increase at the edges of the magnetic layer 716, as compared to the heat maps 800 and 810 generated for devices 700*b* and 700*c*. This variation in the magnetic field strength is due, at least, to the magnetic material in the magnetic layer 716 acting as a magnetic flux guide to draw the magnetic field to its edges and to create a path for the magnetic field lines. On the other hand, the magnetic field gradient, as shown in the heat map 822, increases substantially with the addition of the rectangular magnetic layer 716 due to the high relative permeability.

Figure 11A:
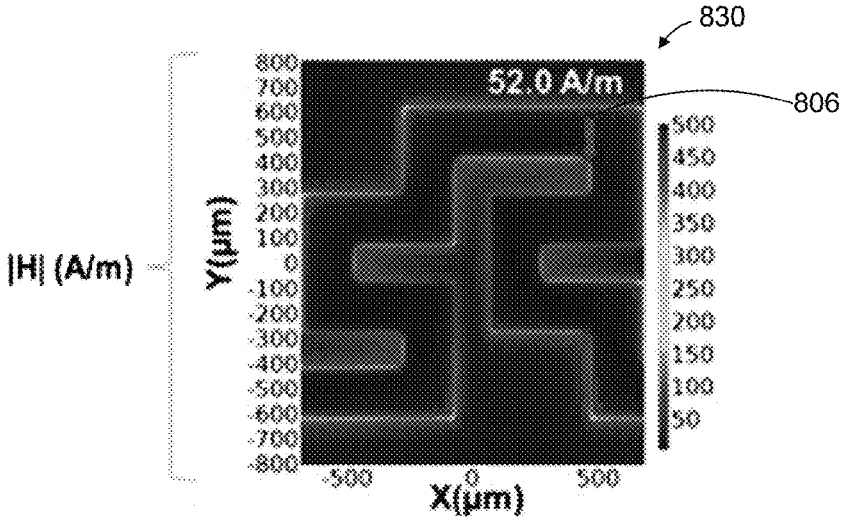
FIG. 11*a* is a heat map representing a magnetic field strength of the example device shown in FIG. 7*d;*
Figure 11B:
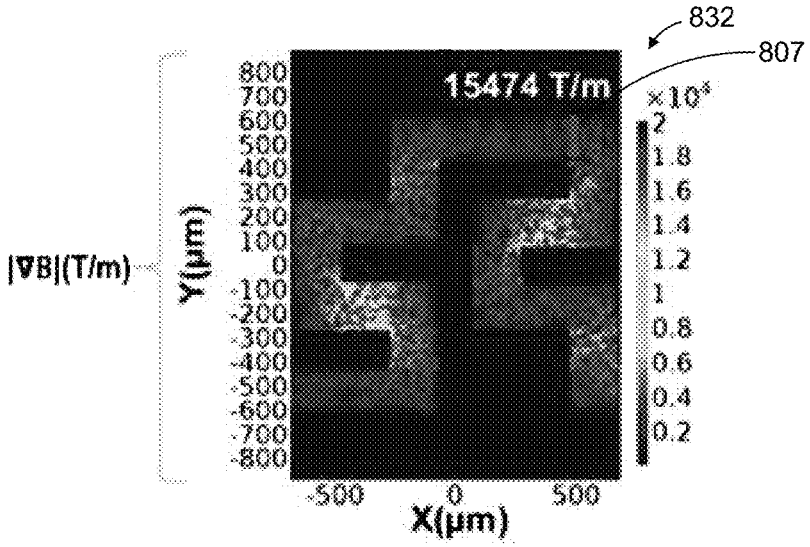
FIG. 11*b* is a heat map representing a magnetic gradient of the example device shown in FIG. 7*d;*
Figure 11C:
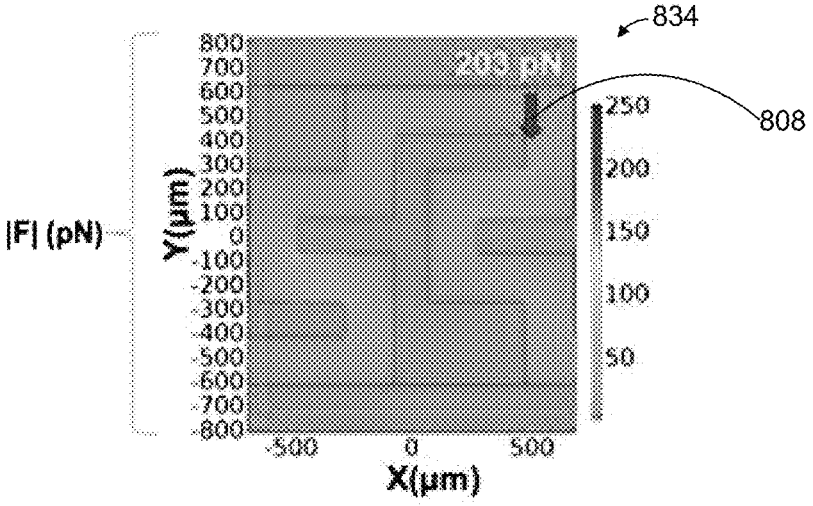
FIG. 11*c* is a heat map representing a magnetic force of the example device shown in FIG. 7*d;*

FIGS. 11*a* to 11*c* show heat maps 830, 832 and 834, respectively, of the magnetic field strength ($|H|$), the magnetic gradient ($|\nabla\vec{B}|$), and the magnetic force ($|F|$) after the current is applied to the example device 700*d*. With the addition of the patterned magnetic layer 716', more magnetic flux guiding edges are present so that the magnetic field strength, as shown in the heat map 830, can be enhanced. Also, the magnetic field gradient and magnetic force, as shown in the heat maps 832 and 834, respectively, are increased at the edges due to the presence of more edges. As will be described with reference to FIGS. 20 to 25, the alignment of the patterned magnetic layer 716' with the conductive element 712 can also increase the mobility of the magnetic particles.

As described, the dimensions of the conductive element 122, 322 can affect its magnetic properties. To illustrate the relationship between the dimensions and the corresponding magnetic properties of the conductive element 122, 322, three conductive elements 122, 322 with different dimensions are modelled and simulated. The spatial distribution of the magnetic field strength ($|H|$), magnetic gradient ($|\nabla\vec{B}|$), and the magnetic force ($|F|$) are computed at the surface of each of the devices to study the magnetic properties in respect of 2.8 μm of magnetic particles after a current of 30 mA is applied. The magnetic particles in this example embodiment are iron oxide magnetic particles with magnetic susceptibility of 0.17.

Figure 12A:
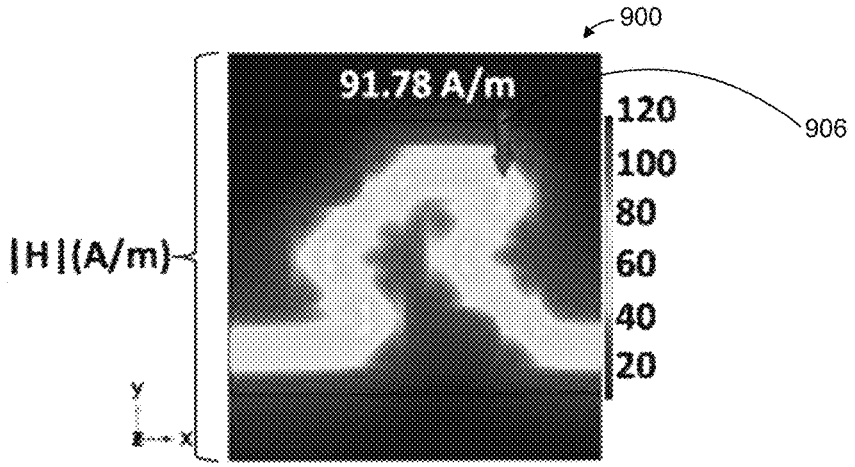
FIG. 12*a* is a heat map representing a magnetic field strength of an example device, in accordance with an example embodiment.
Figure 12B:
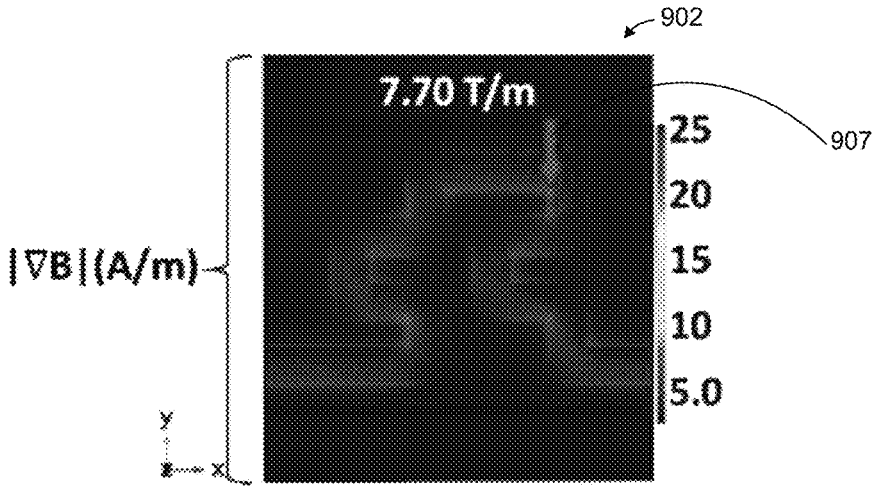
FIG. 12*b* is a heat map representing a magnetic gradient of the example device represented by the heat map shown in FIG. 12*a;*
Figure 12C:
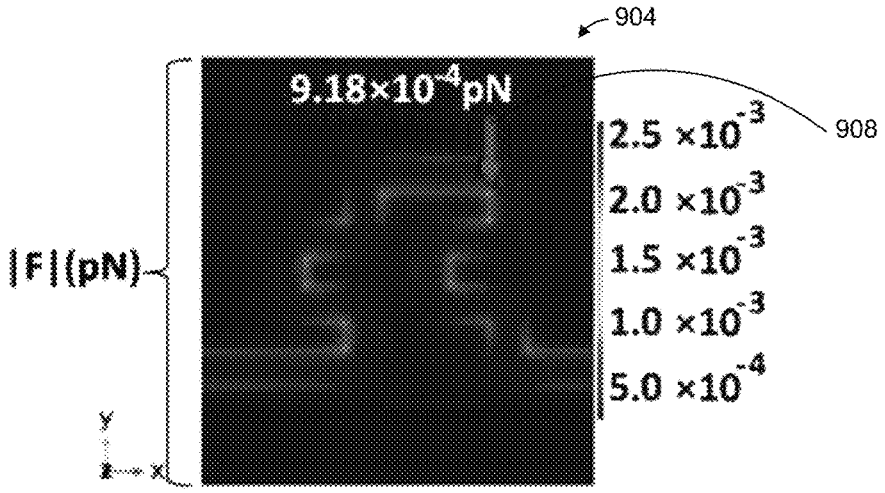
FIG. 12*c* is a heat map representing a magnetic force of the example device represented by the heat map shown in FIG. 12*a;*

FIGS. 12*a* to 12*c* show heat maps 900, 902 and 904, respectively, of the magnetic field strength ($|H|$), the magnetic gradient ($|\nabla\vec{B}|$), and the magnetic force ($|F|$) after the current is applied to a device with a width of 190 μm and a spacing of 140 μm.

From FIGS. 12*a* to 12*c*, it can be seen that the highest magnetic field strength, magnetic gradient and magnetic force are generated inside the loops of the patterned conductive element. For illustrative purposes, arrows 906, 907, and 908 have been added to the respective heat maps 900, 902 and 904 to illustrate the region within the conductive element 122 exhibiting the highest magnetic property values. As described with reference to FIGS. 8*a* to 8*c*, this high value of the magnetic property is due, at least, to the magnetic field components generated by each wire within the loop adding constructively together.

Figure 13A:
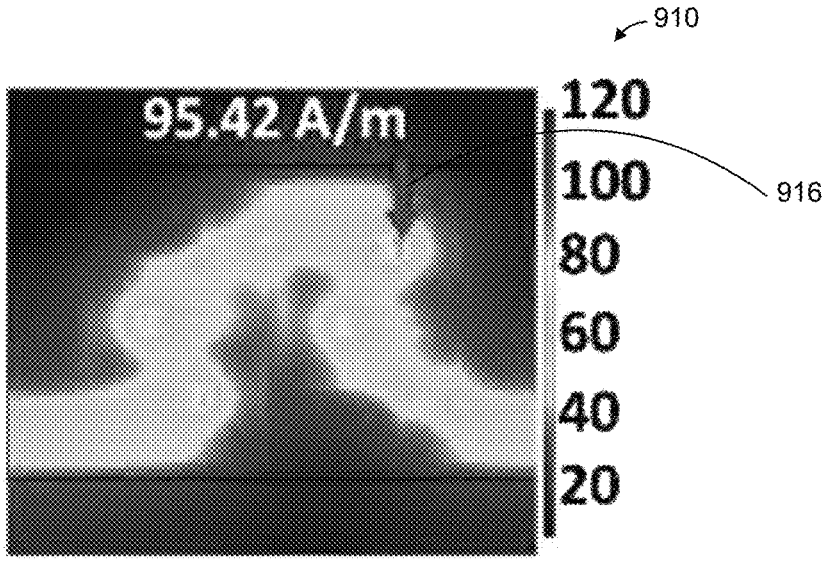
FIG. 13*a* is a heat map representing a magnetic field strength of another example device, in accordance with another example embodiment.
Figure 13B:
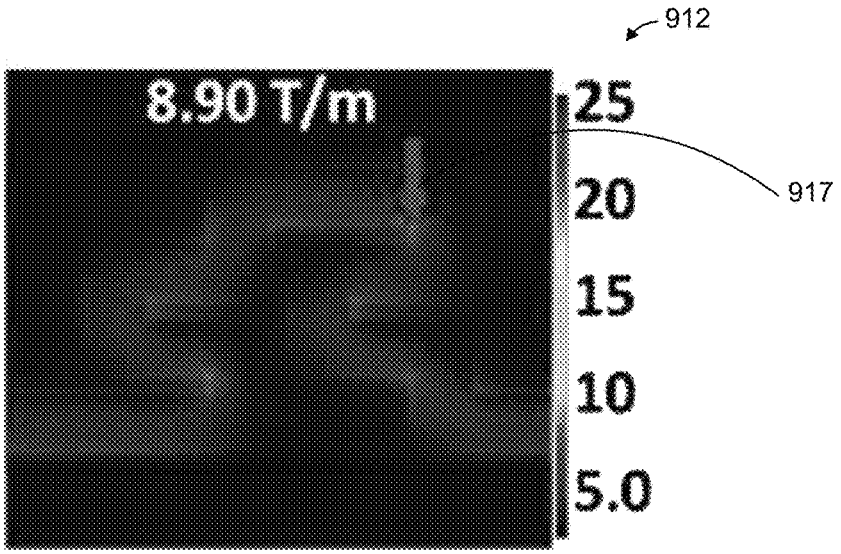
FIG. 13*b* is a heat map representing a magnetic gradient of the example device represented by the heat map shown in FIG. 13*a;*
Figure 13C:
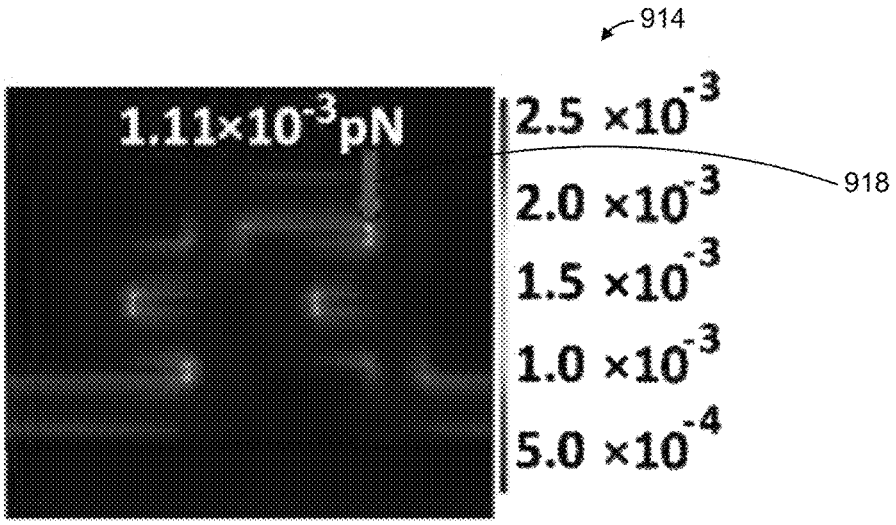
FIG. 13*c* is a heat map representing a magnetic force of the example device represented by the heat map shown in FIG. 13*a;*

FIGS. 13*a* to 13*c* show heat maps 910, 912 and 914, respectively, of the magnetic field strength ($|H|$), the magnetic gradient ($|\nabla\vec{B}|$), and the magnetic force ($|F|$) after the current is applied to a device with a width of 190 μm and a spacing of 60 μm.

In comparing FIGS. 12*a* to 12*c* with FIGS. 13*a* to 13*c*, respectively, it can be seen that, by decreasing the spacing between adjacent wires from 140 μm to 60 μm, a slight increase in the magnetic field strength ($|H|$), the magnetic gradient ($|\nabla\vec{B}|$), and the magnetic force ($|F|$) results. Since the spacing between the current carrying wires becomes smaller, the magnetic field lines become confined within the loops so that slightly larger magnetic forces will be exerted on the magnetic particles.

Figure 14A:
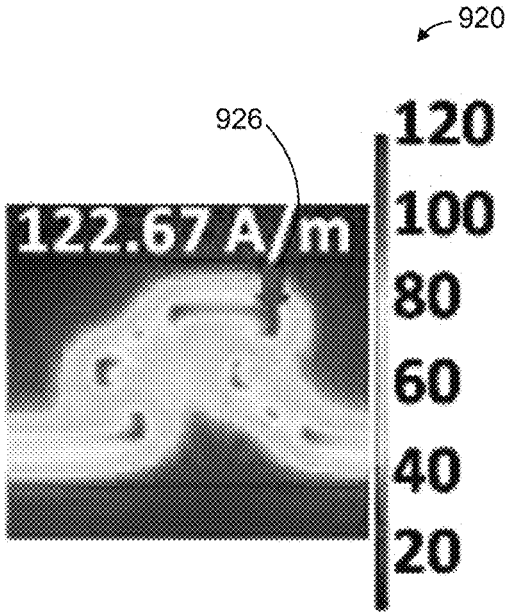
FIG. 14*a* is a heat map representing a magnetic field strength of another example device, in accordance with another example embodiment.
Figure 14B:
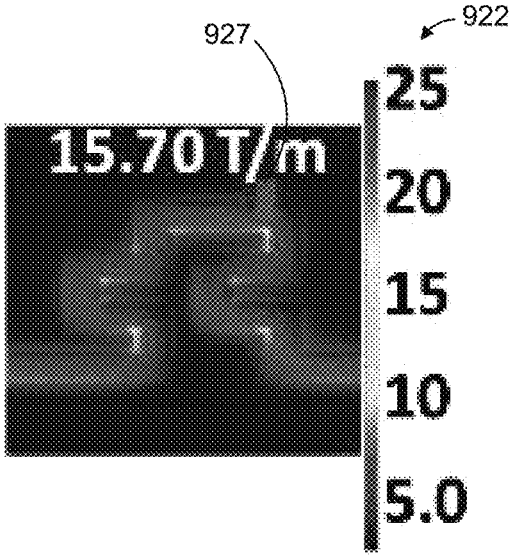
FIG. 14*b* is a heat map representing a magnetic gradient of the example device represented by the heat map shown in FIG. 14*a;*
Figure 14C:
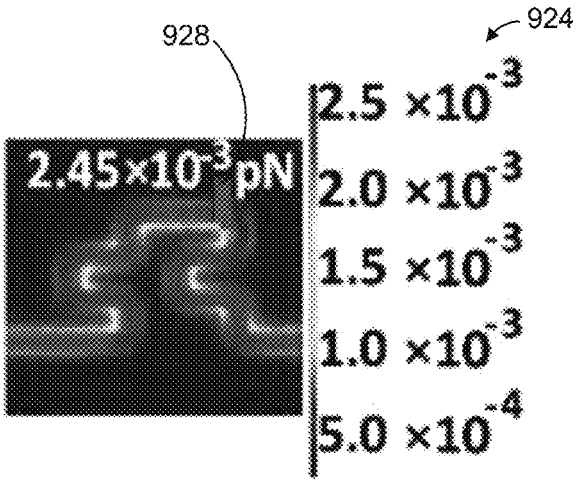
FIG. 14*c* is a heat map representing a magnetic force of the example device represented by the heat map shown in FIG. 14*a;*

FIGS. 14*a* to 14*c* show heat maps 920, 922 and 924, respectively, of the magnetic field strength ($|H|$), the magnetic gradient ($|\nabla\vec{B}|$), and the magnetic force ($|F|$) after the current is applied to a device with a width of 100 μm and a spacing of 70 μm.

By decreasing the width of the conductive element from 190 μm to 100 μm, the generated magnetic field increases from 91.8 A/m to 122.7 A/m, while the magnetic field gradient and magnetic force are enhanced by approximately 2 to 2.7 times, respectively. This behaviour can be explained by the Biot-Savart law.

Figure 15:
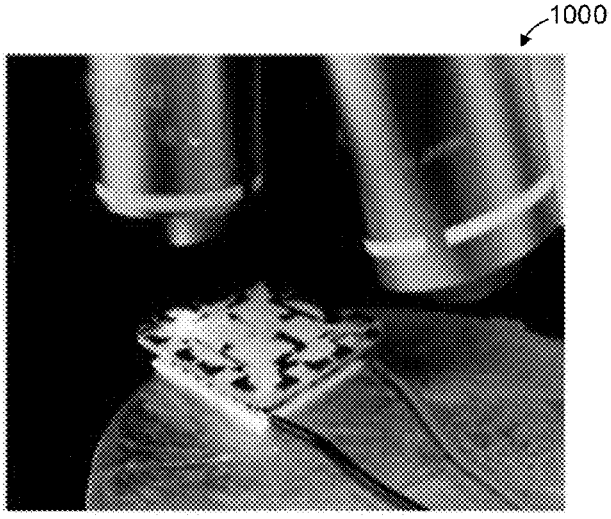
FIG. 15 is a photograph of a portion of an example optical microscope.

Example operations of the devices 50, 60 fabricated with the fabrication processes described herein are monitored with an optical microscope. FIG. 15 is a photograph 1000 of a portion of the lens of the optical microscope.

In an example operation, an aqueous solution of magnetic particles was placed on a device surface. A DC current of 35 mA is applied while the device is continuously cooled with a thermoelectric cooler and a heat sink (e.g., aluminum plate) to avoid device break-down due to Joule heating.

FIGS. 16*a* to 17*b* illustrate the effects of applying a current to the conductive elements of the devices described herein.

Figure 16A:
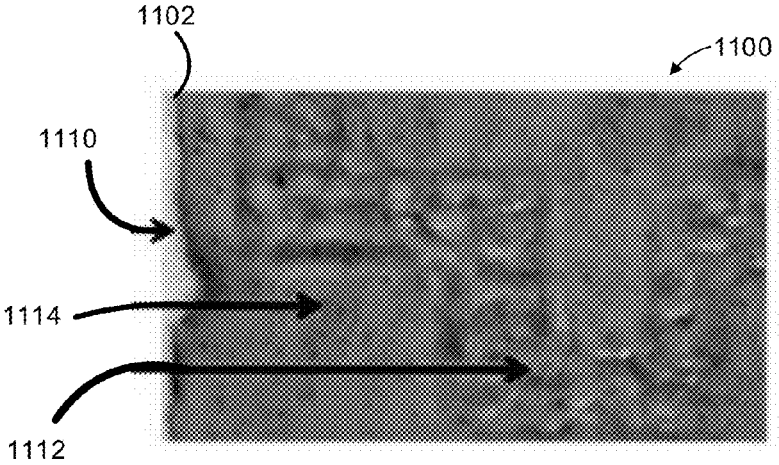
FIG. 16*a* is a partial top view of an example device at an initial time, in accordance with an example embodiment.
Figure 16B:
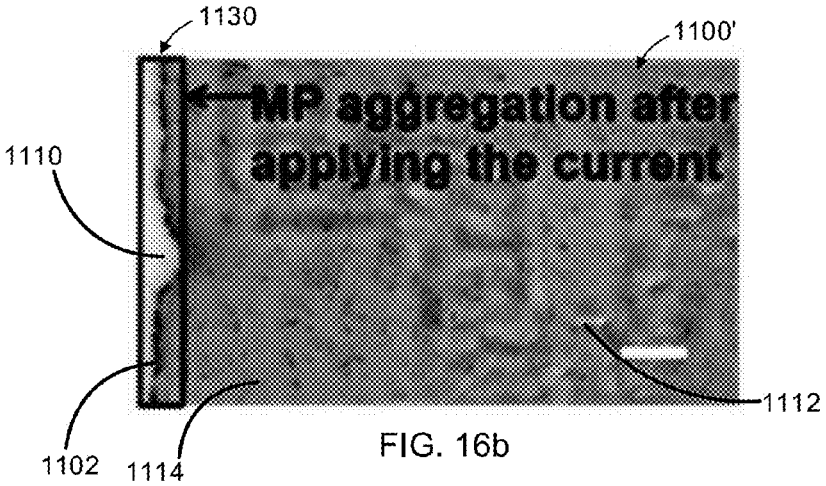
FIG. 16*b* shows the example device of FIG. 16*a* at a later time after a current is applied, in accordance with an example embodiment.

FIGS. 16*a* and 16*b* illustrate a partial top view of an example device 1100 at an initial time and the device 1100' after the current has been applied to the conductive element 1112 for approximately 10 minutes. As shown in FIG. 16*b*, due to the applied current, the magnetic particles 1130 migrate towards an interface 1102 between the conductive seed layer 1110 and the magnetic layer 1114.

Figure 17A:
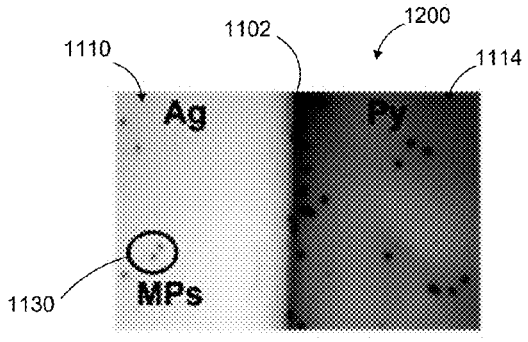
FIG. 17*a* is a partial top view of an example interface between a conductive seed layer and an example conductive element at an initial time, in accordance with an example embodiment.
Figure 17B:
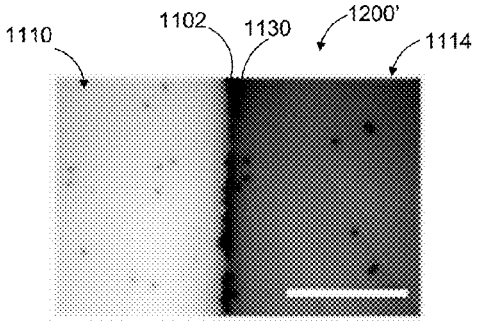
FIG. 17*b* shows the example interface of FIG. 17*a* at a later time after a current is applied, in accordance with an example embodiment.

FIG. 17*a* is a partial top view 1200 of the interface 1102, and FIG. 17*b* shows the interface 1102 after the current has been applied for approximately 10 minutes (generally shown at 1200'). In comparing FIG. 17*a* with FIG. 17*b*, it can be seen that the magnetic particles 1130 are driven towards the interface 1102 and are immobilized at the interface 1102. Some of the magnetic particles 1130 shown in FIG. 17*b* were driven towards the interface 1102 from a distance of approximately 100 μm from the interface 1102.

Figure 18A:
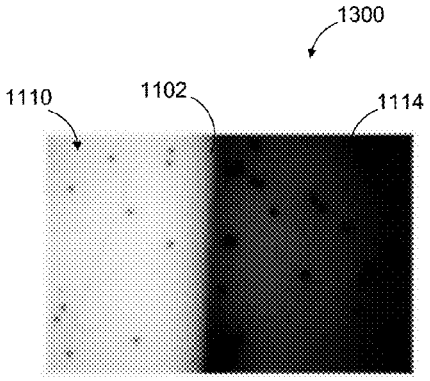
FIG. 18*a* is a partial top view of an example interface between a conductive seed layer and an example conductive element at an initial time, in accordance with an example embodiment.
Figure 18B:
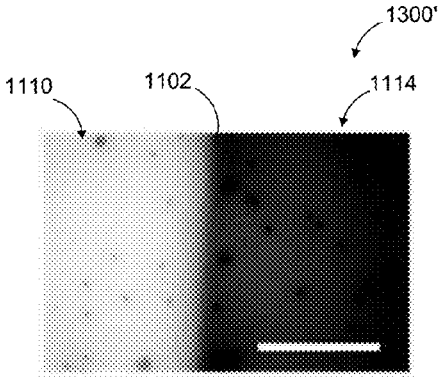
FIG. 18*b* shows the example interface of FIG. 18*a* at a later time after no current has been applied, in accordance with an example embodiment.

FIGS. 18*a* and 18*b* illustrate an example in which no current is applied. FIG. 18*a* is a partial top view 1300 of the interface 1102, and FIG. 18*b* shows the interface 1102 after approximately 10 minutes (generally shown at 1300') when no current is applied.

In the absence of any electrical current, it can be seen from FIG. 18*b* that magnetic particles experience a slow zigzag motion towards the interface 1102. In contrast to the movement of the magnetic particles 1130 shown from a comparison of FIG. 17*a* and FIG. 17*b*, it can be seen that without applying any current, the magnetic particles only occasionally get collected when close to the interface 1102, such as within approximately 5 μm. This sluggish movement of the magnetic particles demonstrated from the comparison of FIG. 18*a* to FIG. 18*b* is mostly due to the stray magnetic fields present at the interface 1102 that originates from the magnetic domain arrangement. In comparing FIG. 17*b* with FIG. 18*b*, it can be seen that very little magnetic particles are collected when no current is applied.

Figure 19:
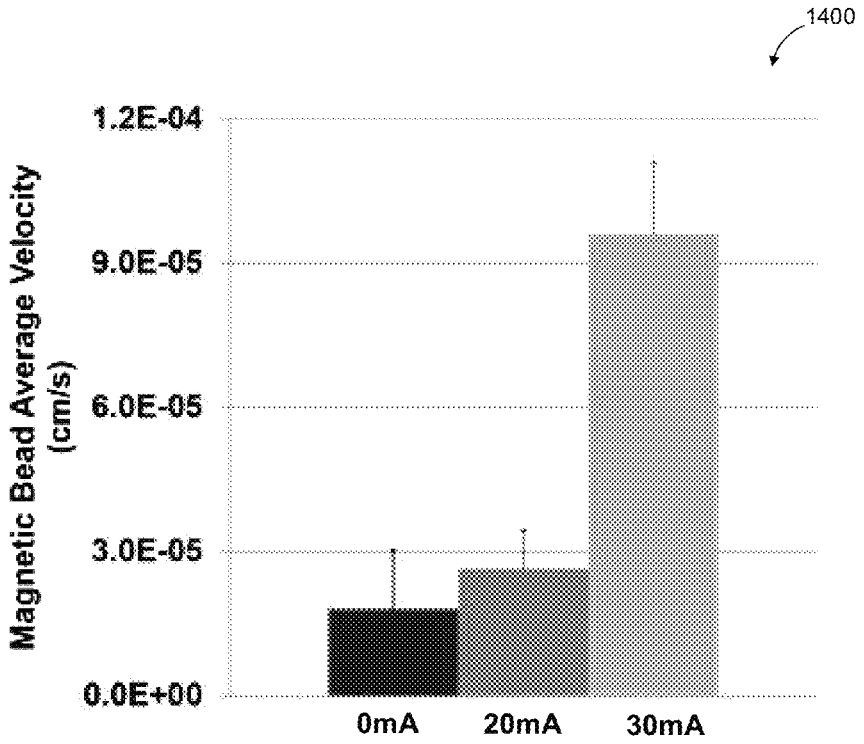
FIG. 19 is a plot of a mean average velocity of magnetic particles with different currents applied, in accordance with an example embodiment.

FIG. 19 shows a plot 1400 of a mean average velocity of magnetic particles in response to the application of different values of current. The mean average velocity values were obtained by dividing a distance travelled by each magnetic particle by its travel time. The error bars shown in the plot 1440 represent a standard deviation.

As shown in FIG. 19, the mean average velocity of the magnetic particles is approximately $2.8\times10^{-4}$ cm/s when 35 mA is applied while the mean average velocity of the magnetic particles when no current is applied is approximately $1.8\times10^{-5}$ cm/s. The difference in the mean average velocity between the application of 35 mA and when no current is applied is more than 13 times. From FIG. 19, it can be seen that substantial increases in the mean average velocity appears when a current between 20 mA to 30 mA is applied.

It should also be noted that the mean average velocity of the magnetic particles continue to increase when larger values of currents are applied. However, the larger current values can result in excessive Joule heating, which could destroy the devices 50, 60.

Reference will now be made to FIGS. 20*a* to 25 for illustrating the effects of patterned magnetic elements on the magnetic properties of the devices 50, 60.

Figure 20A:
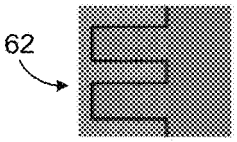
FIG. 20*a* is a partial top view of an example device of the devices shown in FIG. 2.11*b;*
Figure 20B:
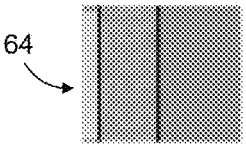
FIG. 20*b* is a partial top view of another example device of the devices shown in FIG. 2.11*b;*
Figure 20C:
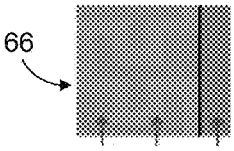
FIG. 20*c* is a partial top view of another example device of the devices shown in FIG. 2.11*b;*
Figure 20D:
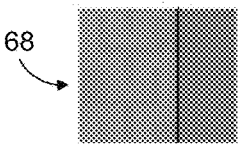
FIG. 20*d* is a partial top view of another example device of the devices shown in FIG. 2.11*b;*

Referring again to FIG. 2.11*b*, as described, the devices 60 contain eight devices with three different dimensions. At edge 62, the devices have a dimension of a width of 100 μm and a spacing of 70 μm, and are also layered with a patterned magnetic element (in this example, the magnetic element is composed of permalloy). An example device at edge 62 is partially shown in FIG. 20*a*. None of the devices at the edges 64, 66 and 68 include a patterned permalloy. At edge 64, the devices have a dimension of a width of 100 μm and a spacing of 70 μm (FIG. 20*b*). At edge 66, the devices have a dimension of a width of 190 μm and a spacing of 140 μm (FIG. 20*c*). At edge 68, the devices have a dimension of a width of 190 μm and a spacing of 60 μm (FIG. 20*d*).

Figure 21A:
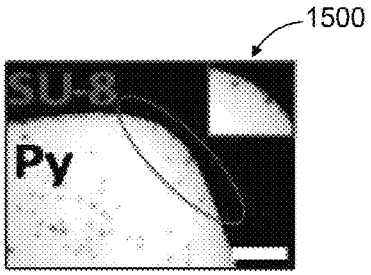
FIG. 21*a* is a partial top view of the example device in FIG. 20*a* at an initial time.
Figure 21B:
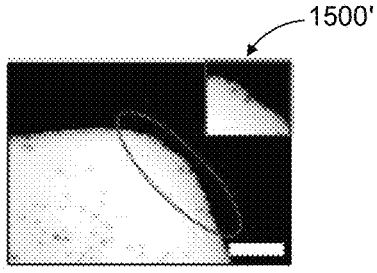
FIG. 21*b* shows the example device in FIG. 21*a* at a later time after a current is applied.
Figure 22A:
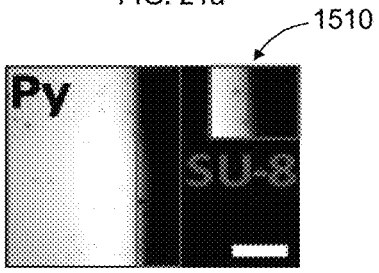
FIG. 22*a* is a partial top view of the example device in FIG. 20*b* at an initial time.
Figure 22B:
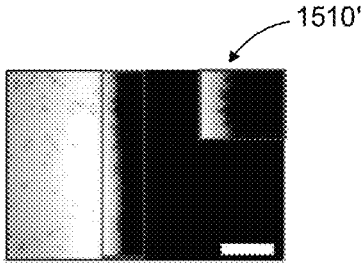
FIG. 22*b* shows the example device in FIG. 22*a* at a later time after a current is applied.
Figure 23A:
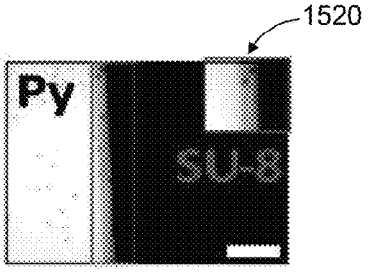
FIG. 23*a* is a partial top view of the example device in FIG. 20*c* at an initial time.
Figure 23B:
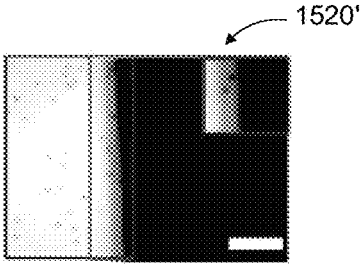
FIG. 23*b* shows the example device in FIG. 23*a* at a later time after a current is applied.
Figure 24A:
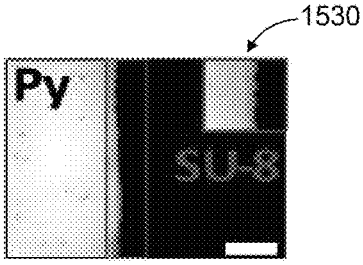
FIG. 24*a* is a partial top view of the example device in FIG. 20*d* at an initial time.
Figure 24B:
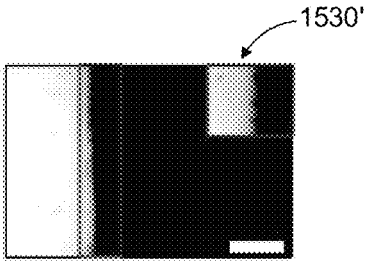
FIG. 24*b* shows the example device in FIG. 24*a* at a later time after a current is applied.

FIGS. 21*a* to 24*b* illustrate the movement of the magnetic particles after a current is applied for approximately 10 minutes to the devices shown in FIGS. 20*a* to 20*d*. FIGS. 21*a* and 21*b* correspond to the devices at edge 62, FIGS. 22*a* and 22*b* correspond to the devices at edge 64, FIGS. 23*a* and 23*b* correspond to the devices at edge 66, and FIGS. 24*a* and 24*b* correspond to the devices at edge 68.

From FIGS. 21*a* to 24*b*, it can be observed that almost no magnetic particles were captured at the interface of the devices at edges 66 and 68 (e.g., wider devices with uniform permalloy), while the devices at edges 62 and 64 (e.g., smaller devices and some with patterned permalloy) captured a greater number of magnetic particles. As will be explained with reference to FIG. 25, immobilization of the magnetic particles at the interface of the permalloy layer for smaller devices and/or patterned permalloy is expected due to higher magnetic field lines and magnetic gradients in those regions.

Figure 25:
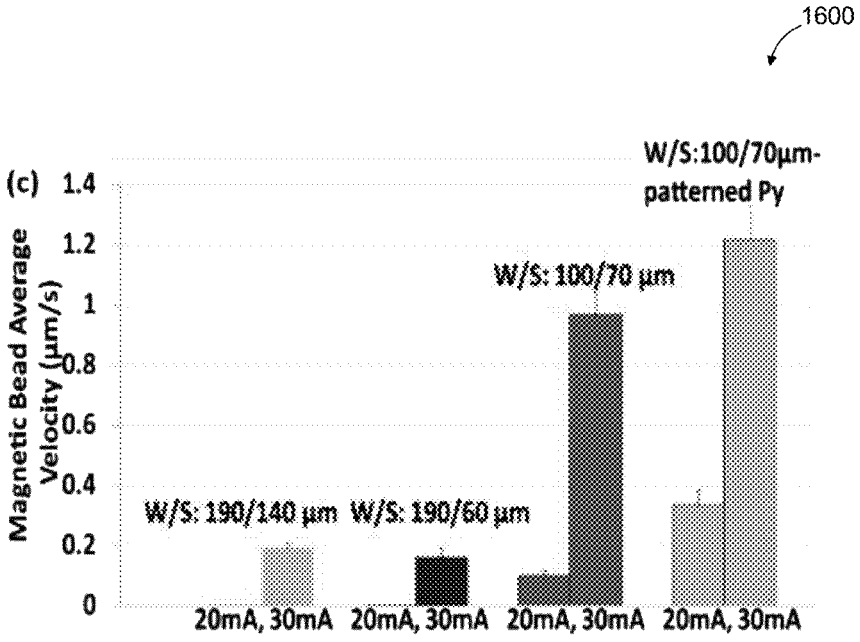
FIG. 25 is an example plot of a mean average velocity of magnetic particles when different currents are applied to the example devices shown in FIGS. 20*a* to 20*d*.

FIG. 25 is a plot 1600 of a mean average velocity of magnetic particles with different currents applied. Similar to the plot 1400 shown in FIG. 19, the error bars in the plot 1600 represent standard deviations. The mean average velocity values are determined from monitoring the time that the magnetic particles require to travel a distance of approximately 37 μm (e.g., from 111 μm to 74 μm away from the interface 1102) when a current of 20 mA is applied and also when a current of 30 mA is applied.

When a current of 20 mA is applied, the devices with a conductive element with a width of 190 μm and a uniform magnetic element (e.g., devices at edges 68 and 66 of devices 60) were unable to generate sufficient magnetic force to attract the magnetic particles. However, as shown in the plot 1600, devices with a conductive element with a width of 100 μm width (e.g., devices at edges 62 and 64 of devices 60) were able to generate sufficient magnetic force to attract the magnetic particles.

When a current of 30 mA is applied, devices 60 were able to generate enough magnetic force to attract the magnetic particles. The average velocity caused by 100 μm width devices with uniform permalloy is about 5 times the average velocity caused by wider devices (190 μm) and uniform permalloy. As described with reference to FIGS. 12*a* to 14*c*, smaller conductive elements can generate larger magnetic field gradients inside the loops.

Also, at 30 mA, 100 μm width devices with patterned magnetic layers increased the mean average velocity by about 6 times in comparison with wider devices (190 μm) and uniform permalloy. Additional edges at the patterned permalloy indicate that there are more magnetic field lines and thus, higher magnetic field gradients and larger magnetic particle capturing sites. Therefore, higher magnetic field gradients are expected at the corners of patterned permalloy, which result in higher magnetic forces and higher mean velocities of magnetic particles.

It will be appreciated that numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description and the drawings are not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Various embodiments have been described herein by way of example only. Various modification and variations may be made to these example embodiments without departing from the spirit and scope of the invention, which is limited only by the appended claims.

The invention claimed is:

1. A device for manipulating magnetic particles, the device comprising:

a substrate;

a conductive element formed onto the substrate in a meandering design pattern shaped to enhance a magnetic field generated in response to a current applied to the conductive element, the conductive element including one of a microstructure having a high aspect ratio and a nanostructure having a high aspect ratio, the conductive element having a wrinkled structure resulting from the substrate being shrunk during fabrication of the device;

an insulating layer; and a magnetic element formed onto the insulating layer, the insulating layer isolates the conductive element from the magnetic element, and the magnetic element enhances a magnetic force resulting from the magnetic field generated by the conductive element.

2. The device of claim 1, further comprising a metallic seed layer deposited onto the insulating layer, the metallic seed layer to act as a conductive path for growth of the magnetic element.

3. The device of claim 2, wherein the metallic seed layer comprises one of copper, titanium, titanium oxide, titanium nitride, tungsten, aluminum, chromium, and noble metals.

4. The device of claim 1, wherein the conductive element comprises an on-chip coil.

5. The device of claim 1, wherein the magnetic element is shaped in the design pattern, and edges of the magnetic element are substantially aligned with corresponding edges of the conductive element.

6. The device of claim 1, wherein the meandering design pattern comprises a mesh shape.

7. The device of claim 1, wherein the substrate comprises a shrinkable material.

8. The device of claim 1, wherein the substrate comprises a polymer material.

9. The device of claim 1, wherein the conductive element comprises one of copper, titanium, titanium oxide, titanium nitride, tungsten, aluminum, chromium, and noble metals.

10. The device of claim 1, wherein the magnetic element comprises one of nickel, iron, permalloy, supermalloy, mu-metal, cobalt-iron alloy, and nickeliron alloy.

11. A device for manipulating magnetic particles, the device comprising:

a substrate;

a conductive element formed onto the substrate in a meandering design pattern shaped to enhance a magnetic field generated in response to a current applied to the conductive element, the conductive element including one of a microstructure having a high aspect ratio and a nanostructure having a high aspect ratio;

an insulating layer; and a magnetic element formed onto the insulating layer, the magnetic element is shaped in the design pattern, and edges of the magnetic element are substantially aligned with corresponding edges of the conductive element, and the insulating layer isolates the conductive element from the magnetic element, and the magnetic element enhances a magnetic force resulting from the magnetic field generated by the conductive element.

12. The device of claim 11, further comprising a metallic seed layer deposited onto the insulating layer, the metallic seed layer to act as a conductive path for growth of the magnetic element.

13. The device of claim 12, wherein the metallic seed layer comprises one of copper, titanium, titanium oxide, titanium nitride, tungsten, aluminum, chromium, and noble metals.

14. The device of claim 11, wherein the conductive element comprises a wrinkled structure resulting from the substrate being shrunk during fabrication of the device.

15. The device of claim 11, wherein the conductive element comprises an on-chip coil.

16. The device of claim 11, wherein the meandering design pattern comprises a mesh shape.

17. The device of claim 11, wherein the substrate comprises a shrinkable material.

18. The device of claim 11, wherein the substrate comprises a polymer material.

19. The device of claim 11, wherein the conductive element comprises one of copper, titanium, titanium oxide, titanium nitride, tungsten, aluminum, chromium, and noble metals.

20. The device of claim 11, wherein the magnetic element comprises one of nickel, iron, permalloy, supermalloy, mu-metal, cobalt-iron alloy, and nickel-iron alloy.

21. A device for manipulating magnetic particles, the device comprising:

a substrate;

a conductive element formed onto the substrate in a meandering design pattern includes a mesh shape so as to enhance a magnetic field generated in response to a current applied to the conductive element, the conductive element including one of a microstructure having a high aspect ratio and a nanostructure having a high aspect ratio;

an insulating layer; and a magnetic element formed onto the insulating layer, the insulating layer isolates the conductive element from the magnetic element, and the magnetic element enhances a magnetic force resulting from the magnetic field generated by the conductive element.

22. The device of claim 21, further comprising a metallic seed layer deposited onto the insulating layer, the metallic seed layer to act as a conductive path for growth of the magnetic element.

23. The device of claim 22, wherein the metallic seed layer comprises one of copper, titanium, titanium oxide, titanium nitride, tungsten, aluminum, chromium, and noble metals.

24. The device of claim 21, wherein the conductive element comprises a wrinkled structure resulting from the substrate being shrunk during fabrication of the device.

25. The device of claim 21, wherein the conductive element comprises an on-chip coil.

26. The device of claim 21, wherein the magnetic element is shaped in the design pattern, and edges of the magnetic element are substantially aligned with corresponding edges of the conductive element.

27. The device of claim 21, wherein the substrate comprises a shrinkable material.

28. The device of claim 21, wherein the substrate comprises a polymer material.

29. The device of claim 21, wherein the conductive element comprises one of copper, titanium, titanium oxide, titanium nitride, tungsten, aluminum, chromium, and noble metals.

30. The device of claim 21, wherein the magnetic element comprises one of nickel, iron, permalloy, supermalloy, mu-metal, cobalt-iron alloy, and nickel-iron alloy.

* * * * *